US009958809B2

(12) United States Patent
Sugahara et al.

(10) Patent No.: US 9,958,809 B2
(45) Date of Patent: May 1, 2018

(54) MAGNETIC CARRIER

(71) Applicant: CANON KABUSHIKI KAISHA, Tokyo (JP)

(72) Inventors: Nobuyoshi Sugahara, Tokyo (JP); Yuto Onozaki, Saitama (JP); Hironori Minagawa, Moriya (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/196,443

(22) Filed: Jun. 29, 2016

(65) Prior Publication Data

US 2016/0306301 A1 Oct. 20, 2016

Related U.S. Application Data

(63) Continuation of application No. PCT/JP2016/001393, filed on Mar. 11, 2016.

(30) Foreign Application Priority Data

Mar. 13, 2015 (JP) ..... 2015-050474

(51) Int. Cl.
*G03G 15/09* (2006.01)
*G03G 9/107* (2006.01)
*G03G 9/113* (2006.01)

(52) U.S. Cl.
CPC ..... *G03G 15/0928* (2013.01); *G03G 9/107* (2013.01); *G03G 9/1133* (2013.01); *G03G 9/1139* (2013.01); *G03G 15/09* (2013.01)

(58) Field of Classification Search
CPC ... G03G 9/1075; G03G 9/1132; G03G 9/1139
See application file for complete search history.

(56) References Cited

U.S. PATENT DOCUMENTS 5,437,949 A 8/1995 Kanbayashi et al.
5,607,806 A 3/1997 Kanbayashi et al.
5,635,326 A 6/1997 Kanbayashi et al.
(Continued)

FOREIGN PATENT DOCUMENTS

JP H08-220811 8/1996
JP 2000-098666 4/2000
(Continued)

*Primary Examiner* — Peter L Vajda
(74) *Attorney, Agent, or Firm* — Fitzpatrick Cella Harper and Scinto

(57) ABSTRACT

A magnetic carrier according to the present invention includes a magnetic carrier core and a resin covering layer formed on a surface of the magnetic carrier core, wherein the resin covering layer contains a resin component and an inorganic fine particle, the inorganic fine particle contains an oxide of a typical metal element or a carbonate of a typical metal element, a moisture adsorption rate of the inorganic fine particle when allowed to stand in an environment of a temperature of 30° C. and a humidity of 80% for 72 hours is 25.0% by mass or less, an electrical conductivity of the inorganic fine particle is $2.0\times10^{-9}$ μS/m or more and $2.5\times10^{-5}$ μS/m or less, and a degree of crystallinity of the inorganic fine particle is 60% or less.

5 Claims, 4 Drawing Sheets

(56) References Cited

U.S. PATENT DOCUMENTS

| | | | | |
|---|---|---|---|---|
| 5,670,288 | A | 9/1997 | Okado et al. | |
| 5,700,617 | A | 12/1997 | Takiguchi et al. | |
| 5,705,306 | A * | 1/1998 | Kitani | G03G 9/08751 430/108.22 |
| 5,747,209 | A | 5/1998 | Takiguchi et al. | |
| 5,851,714 | A | 12/1998 | Taya et al. | |
| 5,912,099 | A | 6/1999 | Kanbayashi et al. | |
| 5,922,500 | A | 7/1999 | Iida et al. | |
| 5,994,018 | A | 11/1999 | Iida et al. | |
| 6,013,402 | A | 1/2000 | Kanbayashi et al. | |
| 6,022,659 | A | 2/2000 | Kanbayashi et al. | |
| 6,077,635 | A | 6/2000 | Okado | |
| 6,165,663 | A * | 12/2000 | Baba | G03G 9/0821 430/111.3 |
| 6,326,114 | B1 | 12/2001 | Itakura et al. | |
| 6,372,400 | B1 | 4/2002 | Yoshizaki et al. | |
| 6,528,222 | B2 | 3/2003 | Kohtaki et al. | |
| 6,586,147 | B2 | 7/2003 | Lida Et A1 | |
| 6,664,016 | B2 | 12/2003 | Kanbayashi et al. | |
| 6,751,424 | B2 | 6/2004 | Komatsu et al. | |
| 6,808,852 | B2 | 10/2004 | Hotta et al. | |
| 6,929,894 | B2 | 8/2005 | Sugahara et al. | |
| 7,115,349 | B2 | 10/2006 | Iida et al. | |
| 7,138,213 | B2 | 11/2006 | Itakura et al. | |
| 7,144,668 | B2 | 12/2006 | Baba et al. | |
| 7,147,980 | B2 | 12/2006 | Itakura et al. | |
| 7,186,063 | B2 | 3/2007 | Volokh | |
| 7,279,262 | B2 | 10/2007 | Fujikawa et al. | |
| 7,288,348 | B2 | 10/2007 | Hayami et al. | |
| 7,297,455 | B2 | 11/2007 | Fujikawa et al. | |
| 7,300,733 | B2 | 11/2007 | Sugahara et al. | |
| 7,396,626 | B2 | 7/2008 | Fujikawa et al. | |
| 7,396,629 | B2 | 7/2008 | Baba et al. | |
| 7,442,478 | B2 | 10/2008 | Itakura et al. | |
| 7,455,947 | B2 | 11/2008 | Ida et al. | |
| 7,536,132 | B2 | 5/2009 | Minagawa | |
| 9,075,328 | B2 | 7/2015 | Minagawa et al. | |
| 9,158,217 | B2 | 10/2015 | Takahashi et al. | |
| 9,372,420 | B2 | 6/2016 | Mizo et al. | |
| 2004/0253528 | A1 | 12/2004 | Yamashita et al. | |
| 2007/0111124 | A1 | 5/2007 | Yuasa et al. | |
| 2009/0154963 | A1 | 6/2009 | Ito | |
| 2012/0052435 | A1 | 3/2012 | Anazawa et al. | |
| 2012/0214098 | A1 | 8/2012 | Fukushima et al. | |
| 2014/0051023 | A1 | 2/2014 | Hotta et al. | |
| 2014/0096409 | A1 | 4/2014 | Ohtsu et al. | |
| 2014/0101966 | A1 | 4/2014 | Minagawa et al. | |
| 2014/0137428 | A1 | 5/2014 | Takenaka et al. | |
| 2014/0356782 | A1 * | 12/2014 | Sugahara | G03G 9/083 430/111.35 |
| 2015/0017581 | A1 | 1/2015 | Tsuchida et al. | |
| 2015/0241807 | A1 | 8/2015 | Sugahara et al. | |
| 2015/0268577 | A1 | 9/2015 | Takahashi et al. | |
| 2015/0309432 | A1 | 10/2015 | Tsujimoto et al. | |
| 2016/0062257 | A1 | 3/2016 | Sugahara et al. | |

FOREIGN PATENT DOCUMENTS

| | | |
|---|---|---|
| JP | 2001-075315 | 3/2001 |
| JP | 2001-194832 | 7/2001 |
| JP | 2011-191612 | 9/2001 |
| JP | 2004-233905 | 8/2004 |
| JP | 2005-233988 | 9/2005 |
| JP | 2006-267297 | 10/2006 |
| JP | 2009-064038 | 3/2009 |
| JP | 2009-145845 | 7/2009 |
| JP | 2012-066990 | 4/2012 |
| JP | 2012-173410 | 9/2012 |
| JP | 2012-252332 | 12/2012 |

* cited by examiner

MAGNETIC CARRIER

CROSS-REFERENCE TO RELATED APPLICATIONS

This application is a continuation of International Application No. PCT/JP2016/001393, filed Mar. 11, 2016, which claims the benefit of Japanese Patent Application No. 2015-050474, filed Mar. 13, 2015.

BACKGROUND OF THE INVENTION

Field of the Invention

The present invention relates to a magnetic carrier used in an image forming method including the step of developing (visualizing) an electrostatic latent image (static charge image) using an electrophotographic method.

Description of the Related Art

Conventionally, for an electrophotographic image forming method, a method including forming an electrostatic latent image on an electrostatic latent image bearing member using various units, and adhering a toner to the electrostatic latent image to develop the electrostatic latent image is generally used. In the development, a two-component development system is widely adopted. In this system, a support particle referred to as a magnetic carrier is mixed with a toner, the mixture is subjected to triboelectric charging to provide an appropriate amount of a positive or negative charge to the toner, and development is performed using the charge as driving force.

In the two-component development system, functions such as the stirring, conveyance, and charging of the developer can be provided to the magnetic carrier, and therefore function assignments of the magnetic carrier and the toner are clear. Thus, the two-component development system has advantages such as good controlling properties of developer performance.

On the other hand, in recent years, due to technical evolution in the electrophotographic field, higher speed and longer life of the apparatus as well as higher definition and the stabilization of image quality have been increasingly severely required. For example, the requirements include maintaining moderate charging properties of the toner particle over a long period, impact resistance, and wear resistance as well as stably maintaining the charging properties of the toner particle against a change in an environment such as humidity or temperature.

In order to satisfy these requirements, various researches and the like have been performed, and various resin covering carriers have been proposed.

In such circumstances, Japanese Patent Application Laid-Open No. 2004-233905, Japanese Patent Application Laid-Open No. 2009-145845, Japanese Patent Application Laid-Open No. 2006-267297, Japanese Patent Application Laid-Open No. 2001-194832, Japanese Patent Application Laid-Open No. 2000-098666, and Japanese Patent Application Laid-Open No. 2012-252332 describe techniques of containing inorganic fine particles in covering resins. Fog, toner scattering, charge maintaining properties, carrier contamination, and environmental stability are improved by these magnetic carriers. But there is still room for improvement regarding environmental stability, particularly image quality stability during environmental change, and further development and study is necessary.

SUMMARY OF THE INVENTION

The present invention is directed to providing a magnetic carrier that solves the problem as described above and specifically to provide a magnetic carrier with which an image having excellent environmental stability can be formed.

The present inventors have found that by using a magnetic carrier having an inorganic fine particle as shown below, a magnetic carrier can be obtained with which charging relaxation particularly in a high temperature and high humidity environment is suppressed, and with which both environmental difference reduction and high image quality can be achieved.

According to one aspect of the present invention, there is provided a magnetic carrier comprising a magnetic carrier core and a resin covering layer formed on a surface of the magnetic carrier core, wherein the resin covering layer contains a resin component and an inorganic fine particle, the inorganic fine particle contains an oxide of a typical metal element or a carbonate of a typical metal element, a moisture adsorption rate of the inorganic fine particle when allowed to stand in an environment of a temperature of 30° C. and a humidity of 80% for 72 hours is 25.0% by mass or less, an electrical conductivity of the inorganic fine particle is $2.0\times10^{-9}$ μS/m or more and $2.5\times10^{-3}$ μS/m or less, and a degree of crystallinity of the inorganic fine particle is 60% or less.

By using the magnetic carrier of the present invention, charging amount decrease in a high temperature and high humidity environment and charging amount increase in a normal temperature and low humidity environment can be suppressed, and an image having stable image density can be provided over a long period.

In addition, by using the magnetic carrier of the present invention, an image having stable density can be output during environmental fluctuation.

Further features of the present invention will become apparent from the following description of exemplary embodiments with reference to the attached drawings.

DESCRIPTION OF THE EMBODIMENTS

Figure 1:
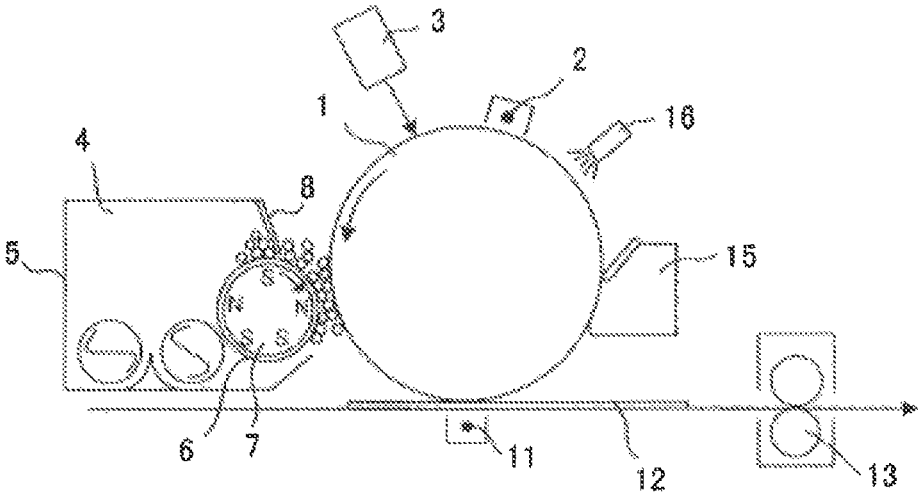
FIG. 1 is a schematic view of an image forming apparatus used in the present invention.

Preferred embodiments of the present invention will now be described in detail in accordance with the accompanying drawings.

The magnetic carrier of the present invention is a magnetic carrier including a magnetic carrier core and a resin covering layer formed on the surface of the magnetic carrier core, wherein the resin covering layer contains a resin component and an inorganic fine particle, the inorganic fine particle contains an oxide of a typical metal element or a carbonate of a typical metal element, the moisture adsorption rate of the inorganic fine particle when allowed to stand in an environment of a temperature of 30° C. and a humidity of 80% for 72 hours is 25.0% by mass or less, the electrical conductivity of the inorganic fine particle is $2.0\times10^{-9}$ μS/m or more and $2.5\times10^{-3}$ μS/m or less, and the degree of crystallinity of the inorganic fine particle is 60% or less.

So far, for the improvement of the charging-providing ability of a magnetic carrier, an organic fine particle, an inorganic compound treated with an aminosilane, or the like has been added. The addition has improved the charging-providing ability of the magnetic carrier but has not led to sufficient stabilization of charging and image density in the case of continuous use in a high temperature and high humidity environment or a normal temperature and low humidity environment over a long period. Therefore, the present inventors have studied in order to solve the above problem, and as a result arrived at the present invention.

As described above, the inorganic fine particle used in the present invention contains an oxide of a typical metal element or a carbonate of a typical metal element. In addition, the degree of crystallinity of the inorganic fine particle is 60% or less. In addition, the electrical conductivity of the inorganic fine particle is $2.0\times10^{-9}$ μS/m or more and $2.5\times10^{-5}$ μS/m or less. In addition, the moisture adsorption rate of the inorganic fine particle when allowed to stand in an environment of a temperature of 30° C. and a humidity of 80% for 72 hours is 25.0% by mass or less.

It has been found that by using such an inorganic fine particle, charging and image density stabilize in the case of continuous use in a high temperature and high humidity environment or a normal temperature and low humidity environment over a long period. In addition, it has been found that the charge maintaining properties particularly in a high temperature and high humidity environment are high, and the image density stabilizes even in environmental fluctuation such as from a normal temperature and low humidity environment to a high temperature and high humidity environment. For this, it is considered that the following effects may be obtained.

First, by setting the degree of crystallinity to 60% or less, a lattice defect occurs in the inorganic fine particle. It is considered that a charge produced by triboelectric charging is temporarily held by the defect, and that thus charge relaxation is less likely to occur even in a high temperature and high humidity environment.

In addition, it is considered that when the electrical conductivity is $2.0\times10^{-9}$ μS/m or more and $2.5\times10^{-5}$ μS/m or less, the relaxation of a charge charged by the triboelectric charging of the covering layer is less likely to occur, and that the above range is an optimal range for providing a charge held in a lattice defect to a toner.

In addition, the moisture adsorption rate is 25.0% by mass or less, and when the moisture adsorption rate exceeds 25.0% by mass, the decrease in charging and the variations in the charging amount grow by the influence of adsorbed moisture to thereby cause density unevenness in an image.

The inorganic fine particle of the present invention that can be used is a fine particle of at least one oxide selected from the group consisting of MgO, $Al_2O_3$, ZnO, $CaCO_3$, $MgCO_3$, and $SrCO_3$.

Examples of a measure for adjusting the degree of crystallinity in the present invention include mechanochemical treatment. Specifically, the degree of crystallinity can be adjusted by performing mechanochemical treatment by a planetary ball mill, a vibrating mill, or the like while controlling treatment intensity and treatment time.

The electrical conductivity correlates with specific resistance. For example, for decreasing the electrical conductivity, the electrical conductivity can be adjusted by surface treatment with an organic compound or the like after mechanochemical treatment. For increasing the electrical conductivity, the electrical conductivity can be adjusted by treating the surface with carbon or a metal.

In addition, the magnetic carrier of the present invention has a current value of 2.0 μA or more and 100.0 μA or less during 500 V application. When the current value is in the above range, the effects of the inorganic fine particle of the present invention are exerted to the maximum.

The content of the inorganic fine particle in the resin covering layer of the magnetic carrier of the present invention can be 1.0 part by mass or more and 10.0 parts by mass or less based on 100 parts by mass of the resin component in the resin covering layer. When the total amount is in the above range, the effects of the inorganic fine particle of the present invention are exerted to the maximum. The resin component in the resin covering layer is hereinafter also referred to as a "covering resin."

In addition, the number average particle diameter of the primary particle of the inorganic fine particle used in the magnetic carrier of the present invention is preferably 15 nm or more and 500 nm or less. The number average particle diameter of the primary particle is more preferably 15 nm or more and 500 nm or less. When the number average particle diameter of the primary particle is in the range, the effects of the inorganic fine particle of the present invention are exerted to the maximum.

Next, the magnetic carrier core will be described.

For the magnetic carrier core, various magnetic particles such as a magnetite particle, a ferrite particle, and a magnetic member-dispersed resin particle can be used. Among them, a magnetic member-dispersed resin particle, a ferrite particle having a hollow shape or a porous shape, or a ferrite particle having such a shape and having a resin contained in the void thereof is suitable because such a particle can decrease the true density of the magnetic carrier.

As the resin contained in the void of the ferrite particle, a copolymer resin used as the covering resin can also be used. But, the resin contained in the void of the ferrite particle is not limited to the copolymer resin, and various resins can be used. Among them, the resin contained in the void of the ferrite particle can be a thermosetting resin. By decreasing the true density of the magnetic carrier, the stress on a toner can be reduced, and the occurrence of toner spent can be suppressed. In addition, the dot reproducibility can be improved, and a high definition image can be obtained.

Examples of a method for obtaining a ferrite particle having a hollow shape or a porous shape include a method involving adjusting the temperature low during firing to control the growth speed of a crystal, and a method involving adding a foaming agent or a void-forming agent of an organic fine particle to produce a void. A magnetic carrier having excellent development properties can be obtained by controlling the atmosphere during firing to low oxygen concentration to control the resistance of the magnetic carrier core.

On the other hand, examples of a specific method for producing a magnetic member-dispersed resin particle include the following methods. For example, a magnetic member-dispersed resin particle can be obtained by performing kneading so as to disperse a submicron magnetic member such as an iron powder, a magnetite particle, or a ferrite particle in a thermoplastic resin, grinding the kneaded material to the desired carrier particle diameter, and performing thermal or mechanical conglobation treatment as needed. A magnetic member-dispersed resin particle can also be produced by dispersing the above magnetic member in a monomer and polymerizing the monomer to form a resin. Examples of the resin in the case include resins such as a vinyl resin, a polyester resin, an epoxy resin, a phenolic resin, a urea resin, a polyurethane resin, a polyimide resin, a cellulose resin, a silicone resin, an acrylic resin, and a polyether resin. The resin may be one resin or a mixed resin of two or more resins. Particularly, a phenolic resin is preferred in terms of increasing the strength of the carrier core. The adjustment of true density and specific resistance can be performed by adjusting the amount of the magnetic member. Specifically, in the case of a magnetic member particle, 70% by mass or more and 95% by mass or less of the magnetic member particle can be added based on the carrier.

For the specific resistance of the magnetic carrier core, the specific resistance value at an electric field strength of 500 V/cm is preferably $1.0\times10^5$ Ω·cm or more and $1.0\times10^{12}$ Ω·cm or less. In terms of being able to increase development properties, the specific resistance value at an electric field strength of 500 V/cm is more preferably $5.0\times10^3$ Ω·cm or more and $1.0\times10^8$ Ω·cm or less. When the specific resistance value is in the above range, a leak can be suitably suppressed even if the coating amount of the resin is not increased. In addition, good development properties are obtained even at low electric field strength.

The specific resistance value of the carrier core can be adjusted by adjusting the specific resistance of the contained magnetic member such as ferrite and changing the amount of the contained magnetic member.

The magnetic carrier core preferably has an intensity of magnetization of 40 $Am^2/kg$ or more and 75 $Am^2/kg$ or less in a magnetic field of 1000/4π (kA/m). The magnetic carrier core more preferably has an intensity of magnetization of 45 $Am^2/kg$ or more and 70 $Am^2/kg$ or less, further preferably 45 $Am^2/kg$ or more and 65 $Am^2/kg$ or less. When the intensity of magnetization of the magnetic carrier core is in the above range, the magnetic restraint on a developing sleeve is moderate, and therefore the occurrence of carrier adhesion can be better suppressed. In addition, the stress applied to a toner in a magnetic brush can be reduced, and therefore the deterioration of the toner and adhesion to other members can be well suppressed. The intensity of magnetization of the magnetic carrier core can be appropriately adjusted by the amount of the contained resin.

The magnetic carrier preferably has a true density of 2.5 $g/cm^3$ or more and 5.0 $g/cm^3$ or less, more preferably 3.0 $g/cm^3$ or more and 4.5 $g/cm^3$ or less. In a two-component-based developer including a magnetic carrier having a true density in the range, the load on the toner is small, and the occurrence of toner spent on the magnetic carrier is suppressed. In addition, also for achieving both good development properties at low electric field strength and the prevention of magnetic carrier adhesion, a true density in the range is preferred for the magnetic carrier.

Next, the magnetic carrier will be described.

The magnetic carrier preferably has a volume-based 50% particle diameter (D50) of 20 μm or more and 100 μm or less from the viewpoint of the ability to provide triboelectric charging to a toner, the suppression of carrier adhesion to an image region, and higher image quality. The magnetic carrier more preferably has a volume-based 50% particle diameter (D50) of 25 μm or more and 70 μm or less.

The method for covering the surface of a magnetic carrier core particle with a covering resin composition (resin composition) is not particularly limited. Examples thereof include methods involving treatment by application methods such as an immersion method, a spraying method, a brush application method, a dry method, and a fluidized bed. Among them, in order to make the most of irregularities, a feature of a porous magnetic core particle surface, an immersion method in which the ratio between the thin portion and thick portion of the covering layer can be controlled is more preferred from the viewpoint of improving development properties.

Examples of the adjustment of a covering resin composition solution for covering include the adjustment of the resin concentration in the covering resin composition solution, the temperature in a covering apparatus, the temperature and the degree of reduced pressure in solvent removal, and the number of resin covering steps.

The covering resin composition amount can be 0.5 parts by mass or more and 6.0 parts by mass or less based on 100 parts by mass of the magnetic carrier core from the viewpoint of charging properties.

The resin of the covering resin composition used for the covering layer is not particularly limited but can be a vinyl-based resin that is a copolymer of a vinyl-based monomer having a cyclic hydrocarbon group in the molecular structure and another vinyl-based monomer.

Specific examples of the cyclic hydrocarbon group include a cyclic hydrocarbon group having 3 or more and 10 or less carbon atoms and are a cyclohexyl group, a cyclopentyl group, an adamantyl group, a cyclopropyl group, a cyclobutyl group, a cycloheptyl group, a cyclooctyl group, a cyclononyl group, a cyclodecyl group, an isobornyl group, a norbornyl group, a boronyl group, and the like. Among them, a cyclohexyl group, a cyclopentyl group, and an adamantyl group are preferred. From the viewpoint of being structurally stable and having high adhesiveness to a resin-filled magnetic core particle, a cyclohexyl group is particularly preferred.

In addition, in order to adjust glass transition temperature (Tg), another monomer may be further contained as a constituent of the vinyl-based resin.

As the another monomer used as a constituent of the vinyl-based resin, various monomers are used. Examples thereof include the following: styrene, ethylene, propylene, butylene, butadiene, vinyl chloride, vinylidene chloride, vinyl acetate, methyl methacrylate, ethyl methacrylate, propyl methacrylate, vinyl methyl ether, vinyl ethyl ether, and vinyl methyl ketone.

Further, the vinyl-based resin used for the covering layer can be a graft polymer because the wettability on the magnetic carrier core particle improves further to thereby form a uniform covering layer.

In order to obtain a graft polymer, a method involving the formation of a trunk chain followed by graft polymerization, a method involving copolymerization using a macromonomer as a monomer, or the like can be employed. A method involving copolymerizing a macromonomer for use is preferred because the molecular weight of the branch chain can be easily controlled.

The macromonomer used is not particularly limited but can be a methyl methacrylate macromonomer because the wettability on the magnetic carrier core improves further.

The amount used when the above macromonomer is polymerized is preferably 10 parts by mass or more and 50 parts by mass or less, more preferably 20 parts by mass or more and 40 parts by mass or less, based on 100 parts by mass of the copolymer of the trunk chain of the vinyl-based resin.

In addition, a particle having electrical conductivity, and a particle and a material having charge controlling properties may be contained in the covering resin composition for use. The particle having electrical conductivity can be carbon black from the viewpoint that by allowing a filler effect to act suitably, the surface tension of the covering resin composition can be allowed to act suitably, and that thus the covering properties of the covering resin composition are improved.

The addition amount of the particle having electrical conductivity can be 0.1 parts by mass or more and 10.0 parts by mass or less based on 100 parts by mass of the covering resin in order to adjust the resistance of the magnetic carrier.

Next, the configuration of a toner preferred for achieving the object of the present invention in the present invention will be described in detail below.

Examples of a binding resin used in the present invention include a vinyl-based resin, a polyester-based resin, and an epoxy resin. Among them, a vinyl-based resin and a polyester-based resin are more preferred in terms of charging properties and fixing properties. Particularly when a polyester-based resin is used, the effect of the introduction of the present apparatus is large.

In the present invention, a homopolymer or copolymer of a vinyl-based monomer, a polyester, a polyurethane, an epoxy resin, polyvinyl butyral, rosin, modified rosin, a terpene resin, a phenolic resin, an aliphatic or alicyclic hydrocarbon resin, an aromatic petroleum resin, or the like can be mixed with the above-described binding resin for use as needed. When two or more resins are mixed and used as a binding resin, resins having different molecular weights can be mixed at an appropriate ratio as a more preferred form.

The glass transition temperature of the binding resin is preferably 45° C. or more and 80° C. or less, more preferably 55° C. or more and 70° C. or less. In addition, the number average molecular weight (Mn) can be 2,500 or more and 50,000 or less, and the weight average molecular weight (Mw) can be 10,000 or more and 1,000,000 or less.

When the toner of the present invention is used as a magnetic toner, examples of the magnetic material included in the magnetic toner include iron oxides such as magnetite, maghemite, and ferrite, and iron oxides including other metal oxides; metals such as Fe, Co, and Ni, or alloys of these metals and metals such as Al, Co, Cu, Pb, Mg, Ni, Sn, Zn, Sb, Be, Bi, Cd, Ca, Mn, Se, Ti, W, and V, and mixtures thereof.

Specific examples of the magnetic material include triiron tetroxide ($Fe_3O_4$), iron sesquioxide ($\gamma$-$Fe_2O_3$), iron zinc oxide ($ZnFe_2O_4$), iron yttrium oxide ($Y_3Fe_5O_{12}$), iron cadmium oxide ($CdFe_2O_4$), iron gadolinium oxide ($Gd_3Fe_5O_{12}$), iron copper oxide ($CuFe_2O_4$), iron lead oxide ($PbFe_{12}O_{19}$), iron nickel oxide ($NiFe_2O_4$), iron neodymium oxide ($NdFe_2O_3$), iron barium oxide ($BaFe_{12}O_{19}$), iron magnesium oxide ($MgFe_2O_4$), iron manganese oxide ($MnFe_2O_4$), iron lanthanum oxide ($LaFeO_3$), an iron powder (Fe), a cobalt powder (Co), and a nickel powder (Ni).

For these, 20 parts by mass or more and 150 parts by mass or less of the magnetic member is preferably used based on 100 parts by mass of the binding resin. More preferably 50 parts by mass or more and 130 parts by mass or less, further preferably 60 parts by mass or more and 120 parts by mass or less, of the magnetic member is used.

Examples of a nonmagnetic colorant used in the present invention include the following.

Examples of a black colorant include carbon black; and a colorant obtained by adjustment to black using a yellow colorant, a magenta colorant, and a cyan colorant.

Examples of a coloring pigment for a magenta toner include the following: a condensed azo compound, a diketopyrrolopyrrole compound, anthraquinone, a quinacridone compound, a base dye lake compound, a naphthol compound, a benzimidazolone compound, a thioindigo compound, and a perylene compound. Specific examples include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269; C.I. Pigment Violet 19, and C.I. Vat Red 1, 2, 10, 13, 15, 23, 29, and 35.

For the colorant, a pigment may be used alone, but in terms of the image quality of a full color image, a dye and a pigment can be used in combination to improve the clearness.

Examples of a dye for a magenta toner include the following: oil-soluble dyes such as C.I Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of a coloring pigment for a cyan toner include the following: C.I. Pigment Blue 1, 2, 3, 7, 15:2, 15:3, 15:4, 16, 17, 60, 62, and 66; C.I. Vat Blue 6, C.I. Acid Blue 45, and a copper phthalocyanine pigment having 1 to 5 phthalimidomethyls substituted on a phthalocyanine skeleton.

Examples of a coloring pigment for yellow include the following: a condensed azo compound, an isoindolinone compound, an anthraquinone compound, an azo metal compound, a methine compound, and an allylamide compound. Specific examples include C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191; and C.I. Vat Yellow 1, 3, and 20. Dyes such as C.I. Direct Green 6, C.I. Basic Green 4, C.I. Basic Green 6, and Solvent Yellow 162 can also be used.

The use amount of the colorant is preferably 0.1 parts by mass or more and 30 parts by mass or less, more preferably 0.5 parts by mass or more and 20 parts by mass or less, and most preferably 3 parts by mass or more and 15 parts by mass or less based on 100 parts by mass of the binding resin.

In addition, a master batch obtained by previously mixing a colorant with a binding resin can be used in the above toner. By melting and kneading the colorant master batch and other raw materials (a binding resin, a wax, and the like), the colorant can be well dispersed in the toner.

A charge-controlling agent can be used in the toner of the present invention as needed, in order to further stabilize the charging properties of the toner. 0.5 Parts by mass or more and 10 parts by mass or less of the charge-controlling agent can be used based on 100 parts by mass of the binding resin.

Examples of the charge-controlling agent include the following.

As a negative charge property-controlling agent for controlling the toner to have negative charge properties, for example, an organometallic complex or a chelate compound is effective. Examples thereof include a monoazo metal complex, a metal complex of an aromatic hydroxycarboxylic acid, and an aromatic dicarboxylic acid-based metal complex. Other examples include an aromatic hydroxycarboxylic acid, aromatic mono- and polycarboxylic acids and metal salts thereof, anhydrides thereof, or esters thereof, or phenol derivatives of bisphenol.

In the present invention, one or two or more release agents may be contained in the toner particle as needed. Examples of the release agent include the following.

Low molecular weight polyethylene, low molecular weight polypropylene, and aliphatic hydrocarbon-based waxes such as a microcrystalline wax and a paraffin wax can be used. In addition, examples of the release agent include oxides of aliphatic hydrocarbon-based waxes such as a polyethylene oxide wax, or block copolymers thereof; waxes including fatty acid esters such as a carnauba wax, Sasolwax, and a montanate wax as main components; and products obtained by deoxidizing part or all of fatty acid esters, such as a deoxidized carnauba wax.

The content of the release agent in the toner particle is preferably 0.1 parts by mass or more and 20 parts by mass or less, more preferably 0.5 parts by mass or more and 10 parts by mass or less, based on 100 parts by mass of the binding resin.

A fine particle that can be externally added to the toner particle to increase fluidity when comparing the fluidity before and after the addition may be used in the toner of the present invention as a fluidity-improving agent. The fine particle is, for example, a fluorine-based resin fine particle such as a vinylidene fluoride fine particle or a polytetrafluoroethylene fine particle; or a silica fine particle such as a wet process silica fine particle or a dry process silica fine particle, a titanium oxide fine particle, an alumina fine particle, or the like subjected to surface treatment with a silane coupling agent, a titanium coupling agent, or a silicone oil for hydrophobization treatment, and a fine particle treated so that the degree of hydrophobization measured by a methanol titration test is a value in the range of 30 or more and 80 or less is particularly preferred.

Preferably 0.1 parts by mass or more and 10 parts by mass or less, more preferably 0.2 parts by mass or more and 8 parts by mass or less, of the inorganic fine particle in the present invention is used based on 100 parts by mass of the toner particle.

When the magnetic carrier of the present invention and the toner are mixed and used as a two-component-based developer, the carrier mixing ratio at the time is preferably 2% by mass or more and 15% by mass or less, more preferably 4% by mass or more and 13% by mass or less, as the concentration of the toner in the developer.

In addition, in a replenishment developer for replenishing a developing device according to a decrease in the toner concentration of the two-component-based developer in the developing device, the amount of the toner can be 2 parts by mass or more and 50 parts by mass or less based on 1 part by mass of a replenishment magnetic carrier.

Next, an image forming apparatus including a developing apparatus using the magnetic carrier of the present invention, a two-component-based developer, and a replenishment developer will be described by giving examples, but the developing apparatus used in the developing method of the present invention is not limited to the above developing apparatus.

<Image Forming Method>

Figure 2:
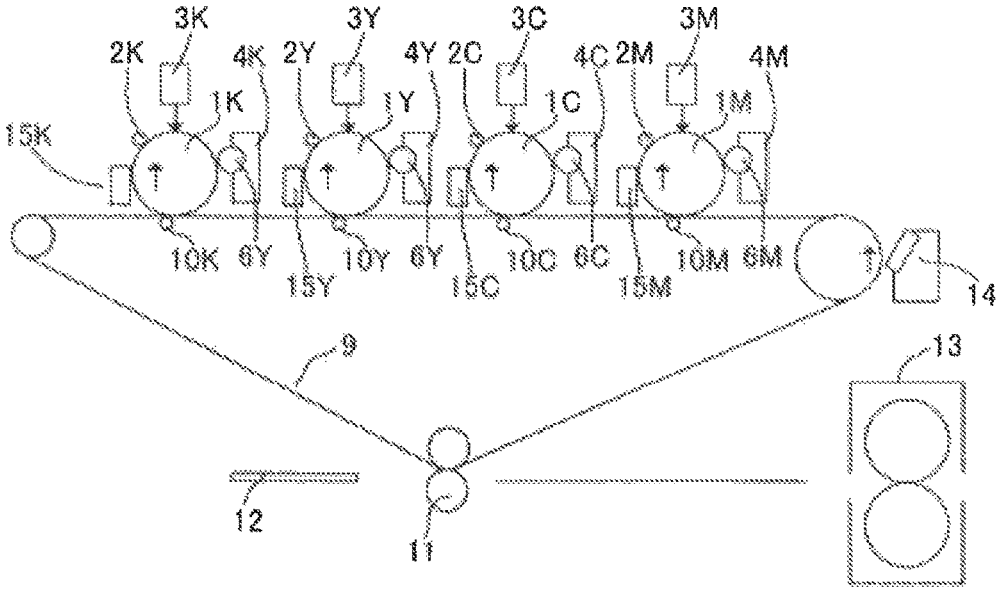
FIG. 2 is a schematic view of an image forming apparatus used in the present invention.

In FIG. 1, an electrostatic latent image bearing member 1 rotates in the arrow direction in the figure. The electrostatic latent image bearing member 1 is charged by a charging device 2 that is a charging unit, and the charged electrostatic latent image bearing member 1 surface is exposed by an exposure device 3 that is an electrostatic latent image forming unit to form an electrostatic latent image. A developing device 4 has a developing container 5 containing a two-component-based developer, and a developer support 6 is disposed in a rotatable state and contains magnets 7 as magnetic field generating units inside the developer support 6. At least one of the magnets 7 is placed so as to be at a position opposed to the latent image support. The two-component-based developer is held on the developer support 6 by the magnetic field of the magnets 7, the two-component-based developer amount is regulated by a regulating member 8, and the two-component-based developer is conveyed to a developing portion opposed to the electrostatic latent image bearing member 1. In the developing portion, a magnetic brush is formed by the magnetic field generated by the magnets 7. Then, by applying a developing bias obtained by superimposing an alternating electric field on a direct current electric field, the electrostatic latent image is turned into a visible image as a toner image. The toner image formed on the electrostatic latent image bearing member 1 is electrostatically transferred to a recording medium 12 by a transfer charging device 11. Here, as illustrated in FIG. 2, the toner image may be transferred from the electrostatic latent image bearing member 1 to an intermediate transfer member 9 once and then electrostatically transferred to the transfer material (recording medium) 12. Then, the recording medium 12 is conveyed to a fixing device 13 and heated and pressurized there, and thus the toner is fixed on the recording medium 12. Then, the recording medium 12 is discharged out of the apparatus as an output image. After the transfer step, the toner remaining on the electrostatic latent image bearing member 1 is removed by a cleaner 15. Then, the electrostatic latent image bearing member 1 cleaned by the cleaner 15 is electrically initialized by light irradiation from preexposure 16, and the above image forming operation is repeated.

FIG. 2 illustrates one example of a schematic view in which the image forming method of the present invention is applied to a full color image forming apparatus.

The arrangement of the image forming units such as K, Y, C, and M and the arrow showing the rotation direction in the figure are not limited to these in any way. In this connection, K means black, Y means yellow, C means cyan, and M means magenta. In FIG. 2, electrostatic latent image bearing members 1K, 1Y, 1C, and 1M rotate in the arrow direction in the figure. The electrostatic latent image bearing members are charged by charging devices 2K, 2Y, 2C, and 2M that are charging units, and the charged electrostatic latent image bearing member surfaces are exposed by exposure devices 3K, 3Y, 3C, and 3M that are electrostatic latent image forming units to form electrostatic latent images. Then, the electrostatic latent images are turned into visible images as toner images by two-component-based developers supported on developer supports 6K, 6Y, 6C, and 6M provided in developing devices 4K, 4Y, 4C, and 4M that are developing units. Further, the toner images are transferred to the intermediate transfer member 9 by intermediate transfer charging devices 10K, 10Y, 10C, and 10M that are transfer units. Further, the obtained toner image is transferred to a recording medium 12 by a transfer charging device 11 that is a transfer unit, and the recording medium 12 is subjected to fixation by heating and pressure by a fixing device 13 that is a fixing unit and output as an image. Then, an intermediate transfer member cleaner 14 that is a cleaning member for the intermediate transfer member 9 recovers the transfer residual toners and the like. The symbols 15K, 15Y, 15C, and 15M denote a cleaner. As the developing method of the present invention, specifically, development can be performed in a state in which the magnetic brush is in contact with the photosensitive member, while an alternating current voltage is applied to the developer support to form an alternating electric field in the developing region. The distance between the developer support (developing sleeve) 6 and the photosensitive drum (electrostatic latent image bearing member) (S-D distance) can be 100 μm or more and 1000 μm or less from the viewpoint of the suppression of carrier adhesion and the improvement of dot reproducibility.

The peak-to-peak voltage (Vpp) of the alternating electric field is 300 V or more and 3000 V or less, preferably 500 V or more and 1800 V or less. In addition, the frequency is 500 Hz or more and 10000 Hz or less, preferably 1000 Hz or more and 7000 Hz or less, and each can be appropriately selected and used depending on the process. In the case, examples of the waveform of the alternating current bias for forming the alternating electric field include a triangular wave, a rectangular wave, a sine wave, or a waveform with a changed Duty ratio. In order to respond to a change in toner image formation speed, a developing bias voltage having a discontinuous alternating current bias voltage (intermittent alternating superimposed voltage) can be applied to the developer support to perform development.

By using a two-component-based developer having a well charged toner, the fog removal voltage (Vback) can be decreased, and the primary charging of the photosensitive member can be decreased, and therefore the photosensitive member life can be made longer. Vback should be 200 V or less, more preferably 150 V or less, though depending on the developing system. As the contrast potential, 100 V or more and 400 V or less can be used so that sufficient image density is obtained.

<Measurement of Degree of Crystallinity of Inorganic Fine Particle>

For the measurement of the degree of crystallinity of the inorganic fine particle, measurement is performed using X-ray powder diffraction (XRD X'Pert PRO-MPD manufactured by PANalytical). X-rays are generated at an acceleration voltage of 45 kV and a current of 40 mA.

Measurement is performed under the following powder X-ray measurement conditions:

Divergence slit, ¼ rad (fixed)
Scattering prevention slit, ½ rad
Solar slit, 0.04 rad
Mask: 15 mm
Antiscatter slit: 7.5 mm
Spinner: present
Measurement method scan axis: Continuous 2θ/θ
Measurement range: $5.0 \leq 2\theta \leq 80°$
Step interval: 0.026 deg/s
Scan speed: 0.525 deg/s For the degree of crystallinity, the same type of inorganic fine particle, and samples whose respective degrees of crystallinity are known are measured and analyzed by analysis software "HighScore Plus."

As the procedure, in "Determine Background," the slider is moved in the "Automatic" mode so that the foot portions of peaks in the measured data of a sample having a known degree of crystallinity are connected, and "Accept" is selected.

Next, a loaded scan file in Scan List is selected, and scan details are displayed. A value is determined so that the number in "Constant Background" in the item "Scan statistics" in the scan details is the same as the value in which the degree of crystallinity is known. The determined value is the apparatus background.

Next, a sample having an unknown degree of crystallinity is measured, and similar processing is performed in "Determine Background." The value of the degree of crystallinity when the apparatus background is input into the "Constant Background" of the scan data is the degree of crystallinity of the inorganic fine particle.

<Method for Measuring Moisture Adsorption Rate of Inorganic Fine Particle>

1.0 g of the inorganic fine particle is weighed by a precision balance onto a stainless steel pan, and the inorganic fine particle mass (W1) after the inorganic fine particle is allowed to stand under an atmosphere of a temperature of 30° C. and a humidity of 80% for 72 hours is measured. Then, the inorganic fine particle mass (W2) after the inorganic fine particle is allowed to stand in a dryer at a set temperature of 100° C. and reduced pressure for 6 hours and dried and after the moisture in the inorganic fine particle is removed is measured.

The moisture adsorption rate of the inorganic fine particle is obtained according to the following formula (1):

$$\text{inorganic fine particle moisture adsorption rate (\%)} = (W1 - W2)/W1 \times 100 \quad (1)$$

<Measurement of Specific Resistance of Magnetic Carrier Core>

Figure 3A:
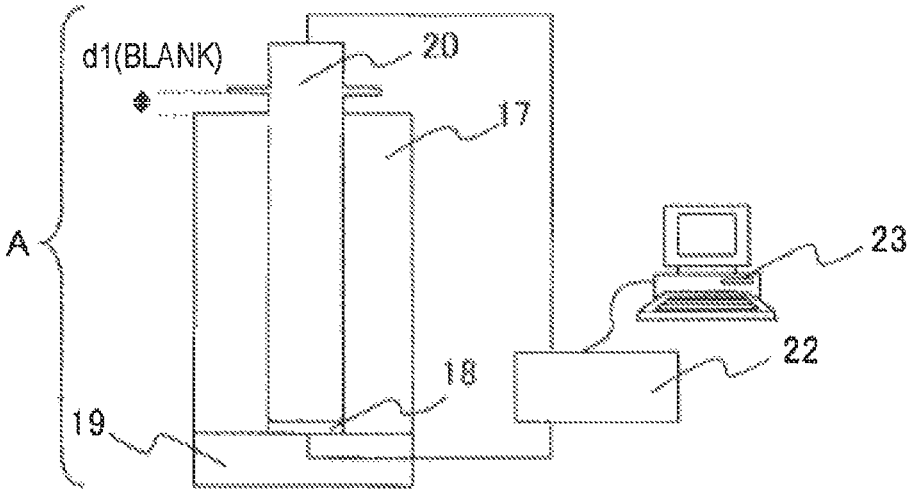
FIG. 3A is a schematic view of an apparatus for measuring the specific resistance of a magnetic carrier used in the present invention.
Figure 3B:
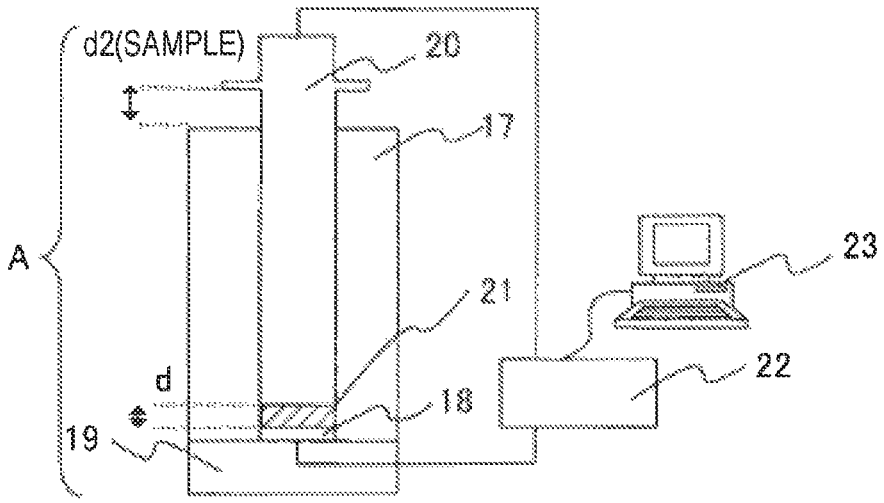
FIG. 3B is a schematic view of the apparatus for measuring the specific resistance of a magnetic carrier used in the present invention.

The specific resistance of the magnetic carrier core is measured using a measuring apparatus outlined in FIG. 3A and FIG. 3B. For the magnetic carrier, the specific resistance at an electric field strength of 500 (V/cm) is measured.

A resistance measuring cell A includes a cylindrical container (made of a PTFE resin) 17 having a hole having a cross-sectional area of 2.4 $cm^2$, a lower electrode (made of stainless steel) 18, a supporting base (made of a PTFE resin) 19, and an upper electrode (made of stainless steel) 20. The cylindrical container 18 is placed on the supporting base 19, a sample (magnetic carrier or carrier core) 21 is filled to a thickness of about 1 mm, the upper electrode 20 is placed on the filled sample 5, and the thickness of the sample is measured. When the gap when there is no sample is d1 as illustrated in FIG. 3A, and the gap when the sample is filled to a thickness of about 1 mm is d2 as illustrated in FIG. 3B, the thickness d of the sample is calculated by the following formula:

$$d = d2 - d1 \text{ (mm)}$$

At the time, the mass of the sample is appropriately changed so that the thickness d of the sample is 0.95 mm or more and 1.04 mm or less.

The specific resistance of the sample can be obtained by applying a direct current voltage between the electrodes and measuring the current flowing at the time. For the measurement, an electrometer 22 (Keithley 6517A manufactured by Keithley) and a processing computer 23 for control are used.

For the processing computer for control, a control system manufactured by National Instruments and control software (LabVEIW manufactured by National Instruments) are used.

As measurement conditions, the contact area between the sample and the electrodes S=2.4 $cm^2$, and the value d actually measured so that the thickness of the sample is 0.95 mm or more and 1.04 mm or less are input. In addition, the load of the upper electrode is 270 g, and the maximum applied voltage is 1000 V.

specific resistance (Ω·cm)=(applied voltage (V)/measured current (A))×$S$ (cm$^2$)/$d$ (cm)

electric field strength (V/cm)=applied voltage (V)/$d$ (cm)

For the specific resistance of the magnetic carrier and the carrier core at the electric field strength, specific resistance at the electric field strength on a graph is read from the graph.

<Measurement of Electrical Conductivity of Inorganic Fine Particle>

For the electrical conductivity of the inorganic fine particle, the reciprocal of "specific resistance" when measured at an electric field strength of 5000 (V/cm) using the same apparatus as the above measurement of the specific resistance of the magnetic carrier core is the electrical conductivity.

For the changed conditions, measurement is performed by a similar method except that the electric field strength is changed, and the mass of the sample is appropriately changed so that the thickness d of the sample is 0.30 mm or more and 0.60 mm or less.

<Method for Measuring Volume-Based 50% Particle Diameter (D50) of Magnetic Carrier>

For the particle size distribution measurement, measurement is performed by a laser diffraction-scattering particle size distribution measuring apparatus "Microtrac MT3300EX" (manufactured by NIKKISO CO., LTD.).

The measurement of the volume-based 50% particle diameter (D50) of the magnetic carrier or the carrier core is performed by mounting a sample feeder for dry measurement "one-shot dry type sample conditioner Turbotrac" (manufactured by NIKKISO CO., LTD.). As the feeding conditions of Turbotrac, a dust collector is used as a vacuum source, the air amount is about 33 l/s, and the pressure is about 17 kPa. The control is automatically performed in software. For the particle diameter, 50% particle diameter (D50) in a volume-based particle size distribution is obtained. The control and analysis are performed using the attached software (version 10.3.3-202D). The measurement conditions are as follows:

SetZero time: 10 seconds
Measurement time: 10 seconds
Number of measurements: 1
Particle refractive index: 1.81%
Particle shape: nonspherical
Measurement upper limit: 1408 μm
Measurement lower limit: 0.243 μm
Measurement environment: 23° C., 50% RH <Measurement of Current Value>

Figure 4:
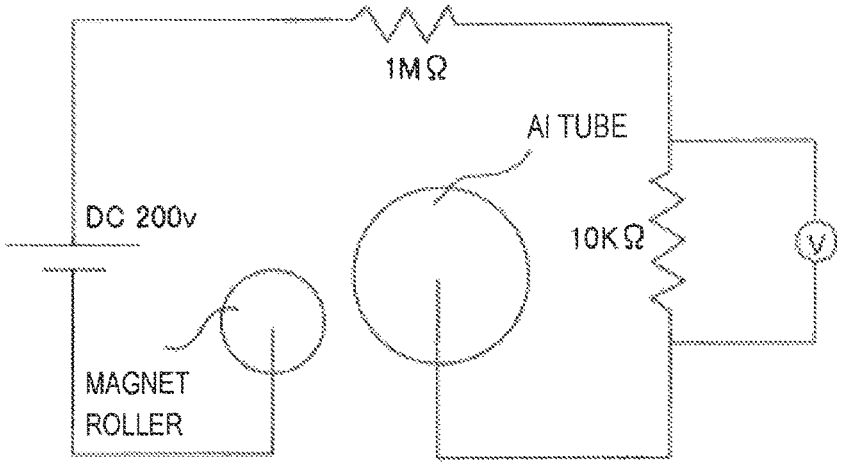
FIG. 4 is a schematic view of an apparatus for measuring the current value of a magnetic carrier used in the present invention.

800 g of the magnetic carrier is weighed and exposed to an environment of a temperature of 20° C. or more and 26° C. or less and a humidity of 50% RH or more and 60% RH or less for 15 minutes or more. Then, measurement is performed at an applied voltage of 500 V using a current value measuring apparatus illustrated in FIG. 4 in which a magnet roller and an Al tube are used as electrodes and disposed with the interval between them being 4.5 mm.

<Method for Measuring Magnetization Amount of Magnetic Carrier Core>

The magnetization amount of the magnetic carrier core can be obtained by a vibrating magnetic field type magnetic characteristic measuring apparatus (Vibrating sample magnetometer) or a direct current magnetization characteristic recording apparatus (B-H tracer). In the present invention, measurement is performed by a vibrating magnetic field type magnetic characteristic measuring apparatus BHV-30 (manufactured by Riken Denshi Co., Ltd.) by the following procedure.

A cylindrical plastic container sufficiently densely filled with the magnetic carrier core is used as a sample, and the magnetization moment in an external magnetic field of 79.6 kA/m (1000 Oe) is measured. In the measurement, a hysteresis loop is measured so that the maximum external magnetic field on the plus side (+79.6 kA/m) is applied, and then the maximum minus external magnetic field (−79.6 kA/m) is applied. The average of the absolute values of the maximum values on the plus side and the minus side at the time is the maximum magnetization moment (emu). In addition, the actual mass of the magnetic carrier core with which the container is filled is measured. The intensity of magnetization (Am$^2$/kg) of the magnetic carrier core is obtained by dividing the maximum magnetization moment by the mass (g).

<Method for Measuring True Density of Magnetic Carrier>

The true density of the magnetic carrier is measured using a dry automatic densimeter AccuPyc 1330 (manufactured by SHIMADZU CORPORATION). First, 5 g of a sample allowed to stand in an environment of 23° C. and 50% RH for 24 hours is precisely weighed and placed in a measurement cell (10 cm$^3$), and the measurement cell is inserted into the main body sample chamber. For the measurement, measurement can be automatically performed by inputting the sample mass into the main body and starting measurement.

For the measurement conditions of the automatic measurement, helium gas adjusted at 20.000 psig ($2.392\times10^2$ kPa) is used. The sample chamber is purged 10 times, and then helium gas is repeatedly purged until an equilibrium state is reached. A state in which the pressure change in the sample chamber reaches 0.005 (psig/min) ($3.447\times10^{-2}$ kPa/min) is the equilibrium state. The pressure of the main body sample chamber during the equilibrium state is measured. The sample volume can be calculated from the pressure change when the equilibrium state is reached (Boyle's law).

The sample volume can be calculated, and thus the true density of the sample can be calculated by the following formula:

the true density of the sample (g/cm$^3$)=sample mass (g)/sample volume (cm$^3$)

The average value of values repeatedly measured 5 times by the automatic measurement is the true density (g/cm$^3$) of the carrier core.

<Method for Measuring Weight Average Particle Diameter (D4) of Toner>

A precision particle size distribution measuring apparatus "Coulter Counter Multisizer 3" (registered trademark, manufactured by Beckman Coulter, Inc.) equipped with a 100 μm aperture tube and based on a pore electrical resistance method, and the attached exclusive software "Beckman Coulter Multisizer 3 Version 3.51" (manufactured by Beckman Coulter, Inc.) for measurement condition setting and measured data analysis are used. Measurement is performed with the number of effective measurement channels being 25000, the analysis of the measured data is performed, and calculation is performed.

For the electrolytic aqueous solution used in the measurement, one obtained by dissolving special grade sodium chloride in ion-exchanged water so that the concentration is about 1% by mass, for example, "ISOTON II" (manufactured by Beckman Coulter, Inc.), can be used.

Before measurement and analysis are performed, the setting of the exclusive software is performed as follows.

In the "Change the Standard Operating Method (SOM) window" of the exclusive software, the total number of counts in the control mode is set to 50000 particles, the number of measurements is set to 1, and a value obtained using "Standard Particle 10.0 μm" (manufactured by Beckman Coulter, Inc.) is set for the Kd value. By pushing the threshold/noise level measurement button, the threshold and the noise level are automatically set. In addition, the current is set to 1600 μA, the gain is set to 2, the electrolytic solution is set to ISOTON II, and the flush of the aperture tube after measurement is checked.

In the "Settings of Conversion from Pulse to Particle Diameter window" of the exclusive software, the bin interval is set to logarithmic particle diameter, the particle diameter bin is set to 256 particle diameter bins, and the particle diameter range is set to 2 μm to 60 μm.

A specific measurement method is as follows.

(1) About 200 ml of the electrolytic aqueous solution is placed in a 250 ml round bottom beaker made of glass exclusive to Multisizer 3, the beaker is set on the sample stand, and stirring by the stirrer rod is performed counterclockwise at 24 rotations/second. Then, dirt and bubbles in the aperture tube are removed by the "Flush of Aperture" function of the analysis software.

(2) About 30 ml of the electrolytic aqueous solution is placed in a 100 ml flat bottom beaker made of glass. As a dispersing agent, about 0.3 ml of a diluted solution obtained by diluting "Contaminon N" (a 10% by mass aqueous solution of a neutral detergent for precision measuring machine cleaning including a nonionic surfactant, an anionic surfactant, and an organic builder and having a pH of 7, manufactured by Wako Pure Chemical Industries, Ltd.) three-fold by mass with ion-exchanged water is added thereto.

(3) A predetermined amount of ion-exchanged water is placed in the water tank of an ultrasonic dispersion machine "Ultrasonic Dispersion System Tetora150" (manufactured by Nikkaki Bios Co., Ltd.) containing two oscillators having an oscillation frequency of 50 kHz in a state in which the phase is shifted by 180 degrees, and having an electrical output of 120 W. About 2 ml of the Contaminon N is added to the water tank.

(4) The beaker in the (2) is set in the beaker fixing hole of the ultrasonic dispersion machine, and the ultrasonic dispersion machine is operated. Then, the height position of the beaker is adjusted so that the resonant state of the liquid surface of the electrolytic aqueous solution in the beaker is the maximum.

(5) In a state in which the electrolytic aqueous solution in the beaker in the (4) is irradiated with ultrasonic waves, about 10 mg of the toner is added to the electrolytic aqueous solution in small amounts and dispersed. Then, the ultrasonic dispersion treatment is further continued for 60 seconds. In the ultrasonic dispersion, adjustment is appropriately performed so that the water temperature of the water tank is 10° C. or more and 40° C. or less.

(6) The electrolyte aqueous solution in the (5) in which the toner is dispersed is dropped into the round bottom beaker in the (1) placed in the sample stand using a pipette, and adjustment is performed so that the measured density is about 5%. Then, measurement is performed until the measured number of particles is 50000.

(7) The measured data is analyzed by the exclusive software attached to the apparatus, and the weight average particle diameter (D4) is calculated. "Average Diameter" in the analysis/volume statistic (arithmetic mean) window when graph/% by volume is set in the exclusive software is the weight average particle diameter (D4).

EXAMPLES

The present invention will be more specifically described below with reference to Examples, but the present invention is not limited only to these Examples.

<Production Examples of Inorganic Fine Particles 1, 2, 10, 11, 14, and 16>

Magnesium oxide in which the number average particle diameter of the primary particle was 500 nm and the degree of crystallinity was 84.9% (inorganic fine particle 16) was ground using "Star Mill LMZ" manufactured by Ashizawa Finetech Ltd. as a grinding apparatus 1. For the grinding medium, a zirconia bead having a bead diameter of 0.05 mm was used. A slurry obtained by mixing the above magnesium oxide and ethanol was passed through the bead mill and ground until the number average particle diameter of the primary particle reached 90 nm. Then, the ethanol was removed, and the sample was dried.

The sample obtained by the grinding apparatus 1 was subjected to treatment using a planetary ball mill "Classic Line P-5" manufactured by Fritsch as a grinding apparatus 2. 15 g of the above sample and 20 alumina balls of 10 mm were placed in a 250 ml container, and treatment was performed for 20 hours. The sample was removed as an inorganic fine particle 1. The number average particle diameter of the primary particle of the inorganic fine particle 1 was 80 nm, and the degree of crystallinity was 31.5%.

In addition, the sample obtained by the grinding apparatus 1 was subjected to treatment in which the treatment time of the grinding apparatus 2 was 50 hours to provide an inorganic fine particle 2. The number average particle diameter of the primary particle of the inorganic fine particle 2 was 70 nm, and the degree of crystallinity was 9.6%.

The sample obtained by the grinding apparatus 1 was subjected to treatment by the grinding apparatus 2 for a treatment time of 2 hours, and the removed sample was treated with 0.1% by mass of 3-glycidoxypropyltrimethoxysilane to provide an inorganic fine particle 10. The number average particle diameter of the primary particle of the inorganic fine particle 10 was 89 nm, and the degree of crystallinity was 60.0%.

Treatment was similarly performed by the grinding apparatus 2 for a treatment time of 2 hours, and the removed sample was treated with 0.1% by mass of 3-aminopropyltrimethoxysilane to provide an inorganic fine particle 11. The number average particle diameter of the primary particle of the inorganic fine particle 11 was 88 nm, and the degree of crystallinity was 60.0%.

Treatment was performed by the grinding apparatus 2 for a treatment time of 1 hour, and the removed sample was treated with 0.2% by mass of 3-aminopropyltrimethoxysilane to provide an inorganic fine particle 14. The number average particle diameter of the primary particle of the inorganic fine particle 14 was 90 nm, and the degree of crystallinity was 61.2%.

Physical properties other than the number average particle diameter of the primary particle and the degree of crystallinity are shown in Table 1.

<Production Examples of Inorganic Fine Particles 3, 8, 12, and 15>

Aluminum oxide in which the number average particle diameter of the primary particle was 83 nm and the degree of crystallinity was 91.0% was ground using the grinding apparatus 1 until the number average particle diameter of the primary particle reached 70 nm. Then, ethanol was removed, and the sample was dried.

The sample obtained by the grinding apparatus 1 was subjected to treatment for 30 hours using the grinding apparatus 2, and the sample was removed to provide an inorganic fine particle 3. The number average particle diameter of the primary particle of the inorganic fine particle 3 was 58 nm, and the degree of crystallinity was 48.6%.

In addition, the inorganic fine particle 3 was treated with 0.3% by mass of 3-aminopropyltrimethoxysilane to provide an inorganic fine particle 8. The number average particle diameter of the primary particle of the inorganic fine particle 8 was 60 nm, and the degree of crystallinity was 48.5%.

The sample obtained by the grinding apparatus 1 was subjected to treatment by the grinding apparatus 2 for a treatment time of 50 hours and treated with 0.1% by mass of 3-aminopropyltrimethoxysilane to provide an inorganic fine particle 12. The number average particle diameter of the primary particle of the inorganic fine particle 12 was 44 nm, and the degree of crystallinity was 22.1%.

In addition, commercial aluminum oxide was treated with 0.3% by mass of 3-aminopropyltrimethoxysilane to provide an inorganic fine particle 15. The number average particle diameter of the primary particle of the inorganic fine particle 15 was 85 nm, and the degree of crystallinity was 90.1%.

Physical properties other than the number average particle diameter of the primary particle and the degree of crystallinity are shown in Table 1.

<Production Examples of Inorganic Fine Particles 4, 9, and 13>

Zinc oxide in which the number average particle diameter of the primary particle was 50 nm and the degree of crystallinity was 90.6% was ground using the grinding apparatus 1 until the number average particle diameter of the primary particle reached 32 nm. Then, ethanol was removed, and the sample was dried.

The sample obtained by the grinding apparatus 1 was subjected to treatment for 30 hours using the grinding apparatus 2, and the sample was removed and treated with 0.1% by mass of 3-aminopropyltrimethoxysilane to provide an inorganic fine particle 4. The number average particle diameter of the primary particle of the inorganic fine particle 4 was 20 nm, and the degree of crystallinity was 50.2%.

The sample obtained by the grinding apparatus 1 was treated by the grinding apparatus 2 for 20 hours to provide an inorganic fine particle 9, and treated for 18 hours to provide an inorganic fine particle 13. The number average particle diameter of the primary particle of the inorganic fine particle 9 was 25 nm, and the degree of crystallinity was 58.9%. The number average particle diameter of the primary particle of the inorganic fine particle 13 was 28 nm, and the degree of crystallinity was 59.6%.

Physical properties other than the number average particle diameter of the primary particle and the degree of crystallinity are shown in Table 1.

<Production Examples of Inorganic Fine Particles 5 to 7>

Calcium carbonate, magnesium carbonate, and strontium carbonate were subjected to treatment for 30 hours using the grinding apparatus 2, and the samples were removed to provide inorganic fine particles 5 to 7 respectively.

The number average particle diameter of the primary particle of the inorganic fine particle 5 was 100 nm, and the degree of crystallinity was 55.0%. The number average particle diameter of the primary particle of the inorganic fine particle 6 was 150 nm, and the degree of crystallinity was 55.4%. The number average particle diameter of the primary particle of the inorganic fine particle 7 was 250 nm, and the degree of crystallinity was 57.6%.

The physical properties of the inorganic fine particles are shown in Table 1.

<Production Examples of Inorganic Fine Particles 17 and 18>

For an inorganic fine particle 17, potassium carbonate with the number average particle diameter of the primary particle: 630 nm and a degree of crystallinity of 88.5% was used.

In addition, for an inorganic fine particle 18, a silica fine particle with the number average particle diameter of the primary particle: 58 nm and a degree of crystallinity of 2.8% treated with 0.5% by mass of hexamethyldisilazane was used. The number average particle diameter of the primary particle: 60 nm and a degree of crystallinity of 2.1% were obtained.

Physical properties other than the number average particle diameter of the primary particle and the degree of crystallinity are shown in Table 1.

TABLE 1

| Inorganic fine particle | Substrate | Grinding apparatus 2 treatment time | Surface treatment: Treating agent type | Surface treatment: Treatment amount (%) | Moisture adsorption rate (%) | Electrical conductivity (μS/m) | Degree of crystallinity (%) | Particle diameter (nm) |
|---|---|---|---|---|---|---|---|---|
| Inorganic fine particle 1 | MgO | 20 hours | — | — | 17.6 | $3.5 \times 10^{-7}$ | 31.5 | 80 |
| Inorganic fine particle 2 | MgO | 50 hours | — | — | 9.6 | $2.1 \times 10^{-8}$ | 9.6 | 70 |
| Inorganic fine particle 3 | Al2O3 | 30 hours | — | 0.1% | 5.6 | $2.0 \times 10^{-8}$ | 48.6 | 58 |
| Inorganic fine particle 4 | ZnO | 30 hours | 3-Aminopropyl-trimethoxy-silane | — | 7.9 | $7.0 \times 10^{-6}$ | 50.2 | 20 |
| Inorganic fine particle 5 | CaCO3 | 30 hours | — | — | 0.5 | $5.8 \times 10^{-8}$ | 55.0 | 100 |

TABLE 1-continued

| Inorganic fine particle | Substrate | Grinding apparatus 2 treatment time | Surface treatment Treating agent type | Treatment amount (%) | Moisture adsorption rate (%) | Electrical conductivity (μS/m) | Degree of crystallinity (%) | Particle diameter (nm) |
|---|---|---|---|---|---|---|---|---|
| Inorganic fine particle 6 | MgCO3 | 30 hours | — | — | 1.0 | $7.6 \times 10^{-8}$ | 55.4 | 150 |
| Inorganic fine particle 7 | SrCO3 | 30 hours | — | 0.3% | 1.9 | $9.4 \times 10^{-8}$ | 57.6 | 250 |
| Inorganic fine particle 8 | Al2O3 | 30 hours | 3-Aminopropyl-trimethoxy-silane | — | 8.8 | $2.0 \times 10^{-9}$ | 48.5 | 60 |
| Inorganic fine particle 9 | ZnO | 20 hours | — | 0.1% | 3.9 | $2.5 \times 10^{-5}$ | 58.9 | 25 |
| Inorganic fine particle 10 | MgO | 2 hours | 3-Glycidoxy-propyl-trimethoxy-silane | 0.1% | 22.5 | $1.0 \times 10^{-5}$ | 60.0 | 89 |
| Inorganic fine particle 11 | MgO | 2 hours | 3-Aminopropyl-trimethoxy silane | 0.1% | 25.0 | $1.5 \times 10^{-5}$ | 60.0 | 88 |
| Inorganic fine particle 12 | Al2O3 | 50 hours | 3-Aminopropyl-trimethoxy silane | — | 8.2 | $1.9 \times 10^{-9}$ | 22.1 | 44 |
| Inorganic fine particle 13 | ZnO | 18 hours | — | 0.2% | 4.1 | $2.8 \times 10^{-5}$ | 59.6 | 28 |
| Inorganic fine particle 14 | MgO | 1 hour | 3-Aminopropyl-trimethoxy-silane | 0.3% | 24.8 | $2.7 \times 10^{-5}$ | 61.2 | 90 |
| Inorganic fine particle 15 | Al2O3 | — | 3-Aminopropyl-trimethoxy-silane | — | 7.6 | $9.2 \times 10^{-10}$ | 90.1 | 85 |
| Inorganic fine particle 16 | MgO | — | — | — | 25.9 | $6.9 \times 10^{-5}$ | 84.9 | 500 |
| Inorganic fine particle 17 | K2CO3 | — | — | 0.5% | 58.5 | $4.8 \times 10^{-4}$ | 88.5 | 630 |
| Inorganic fine particle 18 | SiO2 | — | Hexamethyl-disilazane | — | 3.1 | $2.1 \times 10^{-10}$ | 2.1 | 60 |

<Production Example of Magnetic Carrier Core 1 (Porous Magnetic Core Particle)>

Step 1 (Weighing and Mixing Step)

$Fe_2O_3$ 68.3% by mass $MnCO_3$ 28.5% by mass $Mg(OH)_2$ 2.0% by mass $SrCO_3$ 1.2% by mass The above ferrite raw materials were weighed, 20 parts by mass of water was added to 80 parts by mass of the ferrite raw material, and the mixture was ground to prepare a slurry. The solid concentration of the slurry was 80% by mass.

Step 2 (Temporary Firing Step)

The mixed slurry was dried by a spray dryer (manufactured by Ohkawara Kakohki Co., Ltd.) and then fired in a batch type electric furnace under a nitrogen atmosphere (oxygen concentration 1.0% by volume) at a temperature of 1050° C. for 3.0 hours to make calcined ferrite.

Step 3 (Grinding Step)

The calcined ferrite was ground to about 0.5 mm by a crusher, and then water was added to prepare a slurry. The solid concentration of the slurry was 70% by mass. The slurry was ground by a wet ball mill using a ⅛ inch stainless steel bead for 3 hours to obtain a slurry. The slurry was further ground by a wet bead mill using zirconia having a diameter of 1 mm for 4 hours to obtain a calcined ferrite slurry having a volume-based 50% particle diameter (D50) of 1.3 μm.

Step 4 (Granulation Step)

An ammonium polycarboxylate as a dispersing agent and polyvinyl alcohol as a binder were added to the above calcined ferrite slurry in the proportions of 1.0 part by mass and 1.5 parts by mass respectively based on 100 parts by mass of the calcined ferrite slurry, and then the mixture was granulated into a spherical particle by a spray dryer (manufactured by Ohkawara Kakohki Co., Ltd.) and dried. The obtained granulated material was subjected to particle size adjustment and then heated at 700° C. for 2 hours using a rotary electric furnace to remove organic matter such as the dispersing agent and the binder.

Step 5 (Firing Step)

Under a nitrogen atmosphere (oxygen concentration 1.0% by volume), the time until firing temperature (1100° C.) was reached from room temperature was 2 hours, and the granulated material was held at a temperature of 1100° C. for 4 hours for firing. Then, the temperature was decreased to a temperature of 60° C. over 8 hours, and the atmosphere was returned to the air from the nitrogen atmosphere followed by removal at a temperature of 40° C. or less.

Step 6 (Selection Step)

The aggregated particle was crushed and then sieved by a sieve having an opening of 150 μm to remove the coarse particle. Wind classification was performed to remove the fine powder, and the low magnetic force component was further removed by magnetic separation to obtain a porous magnetic core. The obtained porous magnetic core was porous and had a void.

Step 7 (Filling Step)

100 Parts by mass of the porous magnetic core was placed in the stirring container of a mixing stirrer (universal stirrer model NDMV manufactured by Dalton Co., Ltd.), and a resin solution 1 shown in Table 3 and an acid catalyst were dropped onto the magnetic core particle 1.

After the completion of the dropping, stirring was continued for 2.5 hours as it was, thereby filling the particle of the porous magnetic core with the resin composition obtained from the resin solution 1 to obtain a filled magnetic core 1. The filling amount was adjusted so that the solid of the resin component was 4.0 parts by mass based on 100 parts by mass of the magnetic core.

The obtained filled magnetic core 1 was transferred into a mixer having a spiral blade in a rotatable mixing container (drum mixer model UD-AT manufactured by SUGIYAMA HEAVY INDUSTRIAL CO., LTD.), and under a nitrogen atmosphere, the temperature was increased to the set temperature of the stirrer, 150° C., at a temperature increase speed of 2° C./min. Heating and stirring was performed at the temperature for 1.0 hour to cure the resin, and stirring was further continued for 2.0 hours while the pressure was reduced.

Then, cooling to room temperature was performed, the ferrite particle in which the resin was filled and cured was removed, and the nonmagnetic material was removed using a magnetic separator. Further, the coarse particle was removed by a vibrating sieve to obtain a magnetic carrier core 1 filled with a resin. The physical properties of the obtained carrier core 1 are shown in Table 2.

<Production Example of Magnetic Carrier Core 2 (Ferrite Core Particle)>

Steps 1 to 4

Those produced for the magnetic carrier core 1 were used.

Step 5 (Main Firing Step)

Under a nitrogen atmosphere (oxygen concentration 1.0% by volume), the time until firing temperature (1200° C.) was reached from room temperature was 2 hours, and the granulated material was held at a temperature of 1200° C. for 6 hours for firing. Then, the temperature was decreased to a temperature of 60° C. over 8 hours, and the atmosphere was returned to the air from the nitrogen atmosphere followed by removal at a temperature of 40° C. or less.

Step 6 (Selection Step)

The aggregated particle was crushed and then sieved by a sieve having an opening of 250 μm to remove the coarse particle to obtain a magnetic carrier core 2. The physical properties of the obtained carrier core 2 are shown in Table 2.

<Production Example of Magnetic Carrier Core 3 (Magnetic Member-Dispersed Resin Core Particle)>

4.0% by mass of a silane-based coupling agent (3-(2-aminoethylamino)propyltrimethoxysilane) was added to each of a magnetite powder having a number average particle diameter of 0.30 μm and a hematite powder having a number average particle diameter of 0.30 μm, and each mixture was mixed and stirred at high speed in a container at 100° C. or more to treat each fine particle.

| | |
|---|---|
| phenol | 10 parts by mass |
| a formaldehyde solution (formaldehyde 40%, methanol 10%, water 50%) | 6 parts by mass |
| the treated magnetite | 84 parts by mass |

The above materials, 5 parts by mass of 28% ammonia water, and 20 parts by mass of water were placed in a flask, and while the mixture was stirred and mixed, the temperature was increased to 85° C. in 30 minutes, and the mixture was held. The mixture was subjected to a polymerization reaction for 3 hours, and the produced phenolic resin was cured. Then, the cured phenolic resin was cooled to 30° C., water was further added, then the supernatant liquid was removed, and the precipitate was water-washed and then air-dried. Then, the precipitate was dried under reduced pressure (5 mmHg or less) at a temperature of 180° C. for 5 hours to obtain a spherical magnetic carrier core 3 in a state in which a magnetic member was dispersed. The physical properties of the obtained carrier core 3 are shown in Table 2.

TABLE 2

| Carrier core | Volume average particle diameter (μm) | Specific resistance at electric field strength of 500 V/cm (Ω · cm) | Magnetization amount ($Am^2/kg$) (79.6 kA/m) |
|---|---|---|---|
| 1 | 38.5 | $7.6 \times 10^7$ | 48 |
| 2 | 44.0 | $5.0 \times 10^7$ | 50 |
| 3 | 35.0 | $8.6 \times 10^7$ | 52 |

<Production Examples of Magnetic Carriers 1 to 26>

First, a resin solution 2 shown in Table 3 and 5.0 parts by mass of the inorganic fine particle 1 shown in Table 1 as the solid of a covering resin component were added, and a solvent component was further added to dilute the mixture so that the solid of the covering resin component was 5.0%. The diluted mixture was mixed using a wet bead mill to obtain a dispersion.

Then, the above dispersion was introduced into a planetary motion type mixer (Nauta Mixer model VN manufactured by Hosokawa Micron Corporation) maintained under reduced pressure (1.5 kPa) at a temperature of 60° C. so that the solid of the covering resin component was 2.0 parts by mass based on 100 parts by mass of the magnetic carrier core 1. For the introduction method, first, ½ of the amount of the dispersion was introduced, and solvent removal and application operations were performed for 20 minutes, and then the remaining ½ of the amount of the dispersion was introduced, and solvent removal and application operations were performed for 20 minutes.

Then, the magnetic carrier covered with the covering resin composition was transferred into a mixer having a spiral blade in a rotatable mixing container (drum mixer model UD-AT manufactured by SUGIYAMA HEAVY INDUSTRIAL CO., LTD.). The magnetic carrier was heat-treated under a nitrogen atmosphere at a temperature of 120° C. for 2 hours while being stirred by rotating the mixing container 10 times per minute. For the obtained magnetic carrier 1, the low magnetic force product was separated by magnetic separation, and the magnetic carrier 1 was passed through a sieve having an opening of 150 μm and then classified by a wind classifier. The magnetic carrier 1 having a volume distribution-based 50% particle diameter (D50) of 39.5 μm was obtained. The physical properties values of the obtained magnetic carrier 1 are shown in Table 4.

Further, each of magnetic carriers 2 to 26 was obtained by using a magnetic carrier core shown in Table 4 instead of the magnetic carrier core 1, mixing the resin solution 2 and an inorganic fine particle shown in Table 4 in an addition amount shown in Table 4 by a method similar to the method of the magnetic carrier 1, and performing a covering step by a similar method. The physical properties values of the obtained magnetic carriers 1 to 26 are shown in Table 4.

TABLE 3

| | Resin component | | Solvent component | | Additive | |
|---|---|---|---|---|---|---|
| | Resin varnish | % By mass | Solvent type | % By mass | Additive type | % By mass |
| Resin solution 1 | SR2410 (solid concentration 20%) manufactured by Dow Corning Toray Co., Ltd. | 50.0 | Toluene | 49.5 | γ-aminopropyltriethoxysilane | 0.5 |
| Resin solution 2 | Cyclohexyl methacrylate Methyl methacrylate macromonomer (Mw5000) Methyl methacrylate copolymer (solid proportion 40%) | 50.0 | Toluene | 46.0 | Carbon black #25 manufactured by Mitsubishi Chemical Corporation | 1.0 |

TABLE 4

| | | Resin | Inorganic fine particle | | | | |
|---|---|---|---|---|---|---|---|
| Magnetic carrier | Magnetic carrier core | covering amount (parts by mass) | Inorganic fine particle type | Addition amount (parts by mass) | Carrier particle diameter (μm) | Carrier current value (μA) | Carrier true density (g/cm$^3$) |
| Magnetic carrier 1 | 1 | 2.0 | Inorganic fine particle 1 | 5.0 | 39.5 | 30.0 | 4.0 |
| Magnetic carrier 2 | 1 | 2.0 | Inorganic fine particle 2 | 5.0 | 39.5 | 21.0 | 4.0 |
| Magnetic carrier 3 | 1 | 2.0 | Inorganic fine particle 3 | 5.0 | 39.5 | 19.5 | 4.0 |
| Magnetic carrier 4 | 1 | 2.0 | Inorganic fine particle 4 | 5.0 | 39.5 | 40.5 | 4.0 |
| Magnetic carrier 5 | 1 | 2.0 | Inorganic fine particle 5 | 3.0 | 39.5 | 24.5 | 4.0 |
| Magnetic carrier 6 | 1 | 2.0 | Inorganic fine particle 6 | 8.0 | 39.5 | 48.3 | 4.0 |
| Magnetic carrier 7 | 2 | 0.8 | Inorganic fine particle 7 | 5.0 | 45.0 | 36.0 | 4.7 |
| Magnetic carrier 8 | 1 | 2.0 | Inorganic fine particle 1 | 2.0 | 39.5 | 11.8 | 4.0 |
| Magnetic carrier 9 | 1 | 2.0 | Inorganic fine particle 1 | 9.0 | 39.5 | 55.3 | 4.0 |
| Magnetic carrier 10 | 3 | 1.3 | Inorganic fine particle 1 | 1.0 | 37.0 | 9.6 | 3.6 |
| Magnetic carrier 11 | 1 | 1.8 | Inorganic fine particle 1 | 10.0 | 39.5 | 67.8 | 4.1 |
| Magnetic carrier 12 | 3 | 1.4 | Inorganic fine particle 1 | 0.9 | 37.0 | 2.0 | 3.6 |
| Magnetic carrier 13 | 1 | 1.6 | Inorganic fine particle 1 | 10.1 | 39.5 | 100.0 | 4.1 |
| Magnetic carrier 14 | 3 | 1.5 | Inorganic fine particle 1 | 1.0 | 37.0 | 1.7 | 3.5 |
| Magnetic carrier 15 | 1 | 1.5 | Inorganic fine particle 1 | 10.0 | 39.5 | 102.5 | 4.1 |
| Magnetic carrier 16 | 3 | 1.4 | Inorganic fine particle 8 | 10.0 | 37.0 | 2.0 | 3.6 |
| Magnetic carrier 17 | 1 | 1.5 | Inorganic fine particle 9 | 10.0 | 39.5 | 98.5 | 4.1 |
| Magnetic carrier 18 | 1 | 1.5 | Inorganic fine particle 10 | 10.0 | 39.5 | 98.8 | 4.1 |
| Magnetic carrier 19 | 1 | 1.5 | Inorganic fine particle 11 | 10.0 | 39.5 | 99.2 | 4.1 |
| Magnetic carrier 20 | 1 | 1.5 | Inorganic fine particle 12 | 10.0 | 39.5 | 99.3 | 4.1 |
| Magnetic carrier 21 | 3 | 1.4 | Inorganic fine particle 18 | 10.0 | 37.0 | 1.2 | 3.6 |
| Magnetic carrier 22 | 1 | 1.5 | Inorganic fine particle 13 | 10.0 | 39.5 | 99.4 | 4.1 |
| Magnetic carrier 23 | 1 | 1.5 | Inorganic fine particle 14 | 10.0 | 39.5 | 99.6 | 4.1 |
| Magnetic carrier 24 | 1 | 1.5 | Inorganic fine particle 15 | 10.0 | 39.5 | 99.3 | 4.1 |
| Magnetic carrier 25 | 1 | 1.5 | Inorganic fine particle 16 | 10.0 | 39.5 | 99.7 | 4.1 |
| Magnetic carrier 26 | 1 | 1.5 | Inorganic fine particle 17 | 10.0 | 39.5 | 100.8 | 4.1 |

[Production Example of Toner 1]

| | |
|---|---|
| a binding resin (polyester resin; Tg 58° C., acid value 15 mg KOH/g, hydroxyl group value 15 mg KOH/g, peak molecular weight 5800, number average molecular weight 3500, weight average molecular weight 85000) | 100 parts by mass |
| C.I. Pigment Blue 15:3 | 6.0 parts by mass |
| an aluminum 3,5-di-t-butylsalicylate compound | 0.5 parts by mass |
| a normal paraffin wax (melting point: 78° C.) | 6.0 parts by mass |

The above formulation materials were well mixed by a Henschel mixer (model FM-75J, manufactured by Mitsui Mining Co., Ltd.) and then kneaded in a Feed amount of 10 kg/h by a twin screw kneader (model PCM-30, manufactured by Ikegai Ironworks Corp) set at a temperature of 130° C. (the kneaded material temperature during discharge was about 150° C.) The obtained kneaded material was cooled, crushed by a hammer mill, and then finely ground in a Feed amount of 15 kg/h by a mechanical grinder (T-250: manufactured by Turbo Kogyo Co., Ltd.). Then, a particle having a weight average particle diameter of 5.5 μm was obtained.

The obtained particle was subjected to classification in which a fine powder and a coarse powder were cut by a rotary classifier (TTSP100, manufactured by Hosokawa Micron Corporation). A cyan toner particle 1 having a weight average particle diameter of 6.2 μm was obtained.

Further, the following materials were introduced into a Henschel mixer (model FM-75, manufactured by NIPPON COKE & ENGINEERING COMPANY, LIMITED), the peripheral speed of the rotary blade was set to 35.0 (m/s), and the materials were mixed for a mixing time of 3 minutes to adhere the following silica and titanium oxide to the surface of the cyan toner particle 1 to obtain a cyan toner 1.

| | |
|---|---|
| the cyan toner particle 1 | 100 parts by mass |
| a silica fine particle | 3.5 parts by mass |

(having a primary particle diameter of 110 nm obtained by surface-treating a silica fine particle made by a sol-gel method with 1.5% by mass of hexamethyldisilazane and then adjusting the silica fine particle to the desired particle size distribution by classification)

a titanium oxide fine particle 0.5 parts by mass (having a primary particle diameter of 40 nm obtained by surface-treating metatitanic acid having crystallinity in an anatase form with an octylsilane compound)

<Examples 1 to 19 and Comparative Examples 1 to 7>

9 Parts by mass of each color toner 1 was added to 91 parts by mass of the magnetic carrier 1, and the mixture was shaken by a shaker (model YS-8D: manufactured by YAYOI CO., LTD.) to prepare 300 g of a two-component-based developer of each color. The amplitude conditions of the shaker were 200 rpm and 2 minutes.

On the other hand, 90 parts by mass of each color toner 1 was added to 10 parts by mass of the magnetic carrier 1, and the mixture was mixed in an environment of normal temperature and normal humidity, 23° C./50% RH, by a V-type mixer for 5 minutes to obtain a replenishment developer of each color.

Using the two-component-based developers and replenishment developers, the following evaluations were performed.

As an image forming apparatus, a converted machine of a color copier imageRUNNER ADVANCE C9075 PRO manufactured by Canon Inc. was used.

The above two-component-based developer of each color was placed in each color developing device of the above image forming apparatus, and each replenishment developer container in which each color replenishment developer was placed was set in the apparatus.

The evaluations were performed in environments of a temperature of 23° C./a humidity of 5 RH % (normal temperature and low humidity, hereinafter "N/L") and a temperature of 30° C./a humidity of 80 RH % (high temperature and high humidity, hereinafter "H/H"). In evaluations in the N/L environment, an FFH output chart having an image area proportion of 2% was used, and in evaluations in the H/H environment, an FFH output chart having an image area proportion of 50% was used. FFH is a value representing one of 256 gray levels by a hexadecimal number, and 00h is the 1st gray level of 256 gray levels (white background portion), and FFH is the 256th gray level of 256 gray levels (solid portion).

The number of output images was changed according to each evaluation item.

Conditions:

Paper laser beam printer paper CS-814 (81.4 g/m$^2$) (Canon Marketing Japan Inc.)

Image formation speed Conversion was performed so that images could be output with A4 size, full color, and 80 (images/min).

Development conditions Conversion was performed so that the development contrast could be adjusted at any value, and automatic correction by the main body was not operated.

Conversion was performed so that for each color, an image could be output in a single color.

Evaluation items are shown below.

(1) Fog (Evaluation U)

400000 FFH output charts having an image area proportion of 50% were output in the H/H environment, and then 10 00H output charts having an image proportion of 100% (A4 entire surface solid white images) were output, and the degree of whiteness of the white background portion was measured by a reflectometer (manufactured by Tokyo Denshoku Co., Ltd.). The fog density (%) was calculated from the difference between the degree of whiteness of the white background portion and the degree of whiteness of transfer paper, and among the 10 00H output charts, one having the highest fog density was evaluated. The rating criteria of the evaluation U are as follows:

A (5 points): less than 0.5% (very good)

B (4 points): 0.5% or more and less than 1.0% (good)

C (3 points): 1.0% or more and less than 1.3% (slightly good)

D (2 points): 1.3% or more and less than 1.6% (average)

E (1 point): 1.6% or more and less than 2.0% (the fog is slightly conspicuous)

F (0 points): 2.0% or more (the fog is conspicuous)

The levels at which the image can be considered as a high quality image are A to D. The results are shown in Tables 5 and 6.

(2) Image Density Unevenness (Evaluation V)

400000 FFH output charts having an image area proportion of 50% were output in the H/H environment, and then 10 FFH output charts having an image proportion of 100% (A4 entire surface solid images) were output.

The reflection density was rated by measuring image density by Spectrodensitometer 500 Series (manufactured by X-Rite).

The measurement sites were three points at positions 0.5 cm from the tip of the image (the end printed first) and 5.0 cm, 15.0 cm, and 25.0 cm from the left end of the image (the end printed first was the upper side), three points at positions 7.0 cm from the tip of the image and 5.0 cm, 15.0 cm, and 25.0 cm from the left end of the image, three points at positions 14.0 cm from the tip of the image and 5.0 cm, 15.0 cm, and 25.0 cm from the left end of the image, and three points at positions 20.0 cm from the tip of the image and 5.0 cm, 15.0 cm, and 25.0 cm from the left end of the image, a total of 12 points, and the difference between the highest image density and the lowest image density was obtained. In addition, among the 10 FFH output charts, the largest density difference was the evaluation result. The rating criteria of the evaluation V are as follows:

A (5 points): less than 0.04 (no density unevenness)

B (4 points): 0.04 or more and less than 0.08 (density unevenness cannot be visually confirmed)

C (3 points): 0.08 or more and less than 0.12 (density unevenness is difficult to visually confirm)

D (2 points): 0.12 or more and less than 0.16 (a level at which the density unevenness is not problematic in terms of actual use)

E (1 point): 0.16 or more and less than 0.20 (a level at which the density unevenness is possible in terms of actual use)

F (0 points): 0.20 or more (the density unevenness is slightly conspicuous)

The levels at which the image can be considered as a high quality image are A to D. The results are shown in Tables 5 and 6.

(3) Density Variations

Among the images of 400000 FFH output charts having an image area proportion of 50% output in the H/H environment, the density of the FFH solid portion of every 10000th image was measured. Among the 40 images, the difference between the highest image density and the lowest image density was obtained (evaluation W). The rating criteria of the evaluation W are as follows:

A (10 points): less than 0.04 (no density variations)

B (8 points): 0.04 or more and less than 0.08 (density variations cannot be visually confirmed)

C (6 points): 0.08 or more and less than 0.12 (density variations are difficult to visually confirm)

D (4 points): 0.12 or more and less than 0.16 (density variations are at a nonproblematic level in terms of actual use)

E (2 points): 0.16 or more and less than 0.20 (density variations are at a possible level in terms of actual use)

F (0 points): 0.20 or more (the density unevenness is slightly conspicuous)

Similarly, among the images of 400000 FFH output charts having an image area proportion of 2% output in the N/L environment, the density of the FFH solid portion of every 10000th image was measured. Among the 40 images, the difference between the highest image density and the lowest image density was obtained (evaluation X). The rating criteria of the evaluation X are as follows:

A (5 points): less than 0.04 (no density variations)

B (4 points): 0.04 or more and less than 0.08 (density variations cannot be visually confirmed)

C (3 points): 0.08 or more and less than 0.12 (density variations are difficult to visually confirm)

D (2 points): 0.12 or more and less than 0.16 (density variations are at a nonproblematic level in terms of actual use)

E (1 point): 0.16 or more and less than 0.20 (density variations are at a possible level in terms of actual use)

F (0 points): 0.20 or more (the density unevenness is slightly conspicuous)

(4) Image Density Difference Before and After Standing

400000 FFH output charts having an image area proportion of 50% were output in the H/H environment, and then the main body was allowed to stand still in the same environment for 24 hours, and then 1 FFH output chart of 50% was output.

The density difference between the 400000th image and the image after still standing for 24 hours was obtained (evaluation Y).

The rating criteria of the evaluation Y are as follows:

A (5 points): less than 0.04 (no density difference)

B (4 points): 0.04 or more and less than 0.08 (density difference is difficult to visually confirm)

C (3 points): 0.08 or more and less than 0.12 (a level at which the density difference is not problematic in terms of actual use)

D (2 points): 0.12 or more and less than 0.16 (a level at which the density difference is possible in terms of actual use)

E (1 point): 0.16 or more and less than 0.20 (the density difference is slightly conspicuous)

F (0 points): 0.20 or more (the density difference is conspicuous)

In addition, 400000 FFH output charts having an image area proportion of 2% were output in the N/L environment, and then the main body was allowed to stand still, and the temperature and the humidity were gradually changed so that the environment was the H/H environment after 24 hours. After 24 hours, 1 FFH output chart of 2% was output.

The density difference between the 400000th image and the image after still standing for 24 hours was obtained (evaluation Z).

A (10 points): less than 0.04 (no density difference)

B (8 points): 0.04 or more and less than 0.08 (density difference is difficult to visually confirm)

C (6 points): 0.08 or more and less than 0.12 (a level at which the density difference is not problematic in terms of actual use)

D (4 points): 0.12 or more and less than 0.16 (a level at which the density difference is possible in terms of actual use)

E (2 points): 0.16 or more and less than 0.20 (the density difference is slightly conspicuous)

F (0 points): 0.20 or more (the density difference is conspicuous)

The levels at which the image can be considered as a high quality image are A to D. The results are shown in Tables 5 and 6.

(5) Overall Rating

The evaluation ranks in the above evaluation items (1) to (7) were converted into numerical values, and the total value was rated according to the following criteria:

A: 37 or more and 40 or less (very good)

B: 34 or more and 36 or less (good)

C: 30 or more and 33 or less (slightly good)

D: 21 or more and 29 or less (a level possible in terms of actual use as a high image quality copier)

E: 17 or more and 20 or less (a level at which it is considered difficult to use as a high quality copier in the present invention)

F: 16 or less (a level at which it is considered difficult to use in the present invention)

The results are shown in Table 6.

In Example 1, the result was very good in any evaluation.

In Examples 2 and 3, the type of the inorganic fine particle was different, and the results were very good as in Example 1.

In Example 4, the electrical conductivity was slightly high, and therefore some influence on the density variations at HH was seen.

In Examples 5 to 7, the degree of crystallinity was slightly high, and the electrical conductivity was slightly low, and therefore some influence on the density variations in the NL environment and the density difference before and after standing involving environmental change like the evaluation Z was seen.

In Examples 8, 10, and 12, it is seen that as the addition amount of the inorganic fine particle of the present invention decreases, the density difference after standing and the density variations in the NL environment are influenced. This is influenced by the fact that when the addition amount is small, the effects of the inorganic fine particle of the present invention decrease. In addition, in Examples 9, 11, and 13, it is seen that increasing the addition amount of the inorganic fine particle of the present invention influences the evaluations in the HH environment. This is considered to be so because when the addition amount is large, variations in charging properties are likely to occur.

From the above, it is seen that the magnetic carrier of the present invention exerts excellent effects by adding a proper amount of the inorganic fine particle.

In Examples 10, 12, and 14, it is seen that as the current value of the magnetic carrier decreases, the density difference after standing and the density variations in the NL environment are influenced. In addition, in Examples 11, 13, and 15, it is seen that as the current value of the magnetic carrier increases, the evaluation results in the HH environment and the charge maintaining properties after standing are influenced to some extent.

From the above, the magnetic carrier of the present invention can exert the effects of the inorganic fine particle used in the present invention to the maximum by making the current value proper.

In Example 16, the electrical conductivity was low, and therefore some influence particularly on the density variations in the NL environment and the density difference before and after standing involving environmental change like the evaluation Z was seen. In addition, in Example 17, the electrical conductivity was high, and therefore influence on the evaluation results in the HH environment was seen.

In Example 18, the degree of crystallinity was high, and influence on the density difference before and after standing involving environmental change like the evaluation Z was seen.

In Example 19, due to the influence of the moisture adsorption properties of the inorganic fine particle, influence on the fog and the density unevenness was seen.

But, the evaluations of Examples 1 to 19 were unproblematic in terms of use in overall rating.

In Comparative Examples 1 and 2, the electrical conductivity was too low, and therefore the density variations in the NL environment and the image density difference after standing were influenced.

In Comparative Example 3, the electrical conductivity was too high, and therefore the evaluations in the HH environment and the image density difference after standing were influenced.

In Comparative Examples 4 and 5, the degree of crystallinity was too large, and therefore the variations in image density and the image density difference after standing were influenced.

In Comparative Examples 6 and 7, the moisture adsorption rate was too high, and therefore the evaluations in the HH environment were greatly influenced, and particularly in Comparative Example 7, the results were severe in all evaluations.

TABLE 5

| | | 400000 Sheet endurance HH environment image area proportion 50% endurance | | | | | | | | 400000 Sheet endurance NL environment image area proportion 2% endurance | | | |
|---|---|---|---|---|---|---|---|---|---|---|---|---|---|
| | | U fog | | V image density unevenness | | W density variations (%) | | Y density difference after 1 day standing | | X density variations (%) | | Z density difference after 1 day standing | |
| | Magnetic carrier | Density (%) | Evaluation | Density (%) | Evaluation | Density (%) | Evaluation | Density (%) | Evaluation | Density (%) | Evaluation | Density (%) | Evaluation |
| Example 1 | Magnetic carrier 1 | 0.3 | A | 0.02 | A | 0.02 | A | 0.02 | A | 0.01 | A | 0.02 | A |
| Example 2 | Magnetic carrier 2 | 0.2 | A | 0.02 | A | 0.01 | A | 0.01 | A | 0.01 | A | 0.02 | A |
| Example 3 | Magnetic carrier 3 | 0.3 | A | 0.03 | A | 0.03 | A | 0.02 | A | 0.02 | A | 0.03 | A |
| Example 4 | Magnetic carrier 4 | 0.3 | A | 0.02 | A | 0.04 | B | 0.02 | A | 0.03 | A | 0.03 | A |
| Example 5 | Magnetic carrier 5 | 0.3 | A | 0.02 | A | 0.03 | A | 0.02 | A | 0.04 | B | 0.04 | B |
| Example 6 | Magnetic carrier 6 | 0.4 | A | 0.02 | A | 0.03 | A | 0.03 | A | 0.04 | B | 0.05 | B |
| Example 7 | Magnetic carrier 7 | 0.4 | A | 0.03 | A | 0.03 | A | 0.03 | A | 0.05 | B | 0.05 | B |
| Example 8 | Magnetic carrier 8 | 0.4 | A | 0.02 | A | 0.03 | A | 0.04 | B | 0.05 | B | 0.05 | B |
| Example 9 | Magnetic carrier 9 | 0.5 | B | 0.03 | A | 0.05 | B | 0.03 | A | 0.06 | B | 0.03 | A |
| Example 10 | Magnetic carrier 10 | 0.4 | A | 0.03 | A | 0.03 | A | 0.05 | B | 0.08 | C | 0.06 | B |

TABLE 5-continued

| | | 400000 Sheet endurance HH environment image area proportion 50% endurance | | | | | | | | 400000 Sheet endurance NL environment image area proportion 2% endurance | | | |
|---|---|---|---|---|---|---|---|---|---|---|---|---|---|
| | | U fog | | V image density unevenness | | W density variations (%) | | Y density difference after 1 day standing | | X density variations (%) | | Z density difference after 1 day standing | |
| | Magnetic carrier | Density (%) | Evaluation | Density (%) | Evaluation | Density (%) | Evaluation | Density (%) | Evaluation | Density (%) | Evaluation | Density (%) | Evaluation |
| Example 11 | Magnetic carrier 11 | 0.6 | B | 0.04 | B | 0.06 | B | 0.03 | A | 0.03 | A | 0.07 | B |
| Example 12 | Magnetic carrier 12 | 0.4 | A | 0.03 | A | 0.03 | A | 0.08 | C | 0.09 | C | 0.08 | C |
| Example 13 | Magnetic carrier 13 | 1.1 | C | 0.05 | B | 0.07 | B | 0.07 | B | 0.03 | A | 0.07 | B |
| Example 14 | Magnetic carrier 14 | 0.4 | A | 0.03 | A | 0.03 | A | 0.09 | C | 0.12 | D | 0.09 | C |
| Example 15 | Magnetic carrier 15 | 0.7 | B | 0.08 | C | 0.09 | C | 0.07 | B | 0.03 | A | 0.07 | B |
| Example 16 | Magnetic carrier 16 | 0.8 | B | 0.07 | B | 0.07 | B | 0.07 | B | 0.13 | D | 0.10 | C |
| Example 17 | Magnetic carrier 17 | 1.2 | C | 0.09 | C | 0.10 | C | 0.09 | C | 0.03 | A | 0.11 | C |
| Example 18 | Magnetic carrier 18 | 1.2 | C | 0.12 | D | 0.10 | C | 0.10 | C | 0.03 | A | 0.13 | D |
| Example 19 | Magnetic carrier 19 | 1.4 | D | 0.13 | D | 0.10 | C | 0.11 | C | 0.03 | A | 0.13 | D |
| Comparative Example 1 | Magnetic carrier 20 | 1.2 | C | 0.14 | D | 0.11 | C | 0.13 | D | 0.17 | E | 0.11 | C |
| Comparative Example 2 | Magnetic carrier 21 | 1.2 | C | 0.10 | C | 0.11 | C | 0.12 | D | 0.21 | F | 0.11 | C |
| Comparative Example 3 | Magnetic carrier 22 | 1.4 | D | 0.11 | C | 0.12 | D | 0.14 | D | 0.06 | B | 0.13 | D |
| Comparative Example 4 | Magnetic carrier 23 | 1.5 | D | 0.13 | D | 0.13 | D | 0.15 | D | 0.09 | C | 0.14 | D |
| Comparative Example 5 | Magnetic carrier 24 | 0.9 | B | 0.11 | C | 0.16 | E | 0.16 | E | 0.10 | C | 0.15 | D |
| Comparative Example 6 | Magnetic carrier 25 | 1.5 | D | 0.15 | D | 0.17 | E | 0.18 | E | 0.11 | C | 0.12 | D |
| Comparative Example 7 | Magnetic carrier 26 | 1.7 | E | 0.18 | E | 0.18 | E | 0.19 | E | 0.19 | E | 0.19 | E |

TABLE 6

| | Evaluation U | | Evaluation V | | Evaluation W | | Evaluation X | | Evaluation Y | | Evaluation Z | | | |
|---|---|---|---|---|---|---|---|---|---|---|---|---|---|---|
| | Result | Numerical value | Result | Numerical value | Result | Numerical value | Result | Numerical value | Result | Numerical value | Result | Numerical value | Rating index | Overall evaluation |
| Example 1 | A | 5 | A | 5 | A | 10 | A | 5 | A | 5 | A | 10 | 40 | A |
| Example 2 | A | 5 | A | 5 | A | 10 | A | 5 | A | 5 | A | 10 | 40 | A |
| Example 3 | A | 5 | A | 5 | A | 10 | A | 5 | A | 5 | A | 10 | 40 | A |
| Example 4 | A | 5 | A | 5 | B | 8 | A | 5 | A | 5 | A | 10 | 38 | A |
| Example 5 | A | 5 | A | 5 | A | 10 | B | 4 | A | 5 | B | 8 | 37 | A |
| Example 6 | A | 5 | A | 5 | A | 10 | B | 4 | A | 5 | B | 8 | 37 | A |
| Example 7 | A | 5 | A | 5 | A | 10 | B | 4 | A | 5 | B | 8 | 37 | A |
| Example 8 | A | 5 | A | 5 | A | 10 | B | 4 | B | 4 | B | 8 | 36 | B |
| Example 9 | B | 4 | A | 5 | B | 8 | B | 4 | A | 5 | A | 10 | 36 | B |
| Example 10 | A | 5 | A | 5 | A | 10 | C | 3 | B | 4 | B | 8 | 35 | B |
| Example 11 | B | 4 | B | 4 | B | 8 | A | 5 | A | 5 | B | 8 | 34 | B |
| Example 12 | A | 5 | A | 5 | A | 10 | C | 3 | C | 3 | C | 6 | 32 | C |
| Example 13 | C | 3 | B | 4 | B | 8 | A | 5 | B | 4 | B | 8 | 32 | C |
| Example 14 | A | 5 | A | 5 | A | 10 | D | 2 | C | 3 | C | 6 | 31 | C |
| Example 15 | B | 4 | C | 3 | C | 6 | A | 5 | B | 4 | B | 8 | 30 | C |
| Example 16 | B | 4 | B | 4 | B | 8 | D | 2 | B | 4 | C | 6 | 28 | D |
| Example 17 | C | 3 | C | 3 | C | 6 | A | 5 | C | 3 | C | 6 | 26 | D |
| Example 18 | C | 3 | D | 2 | C | 6 | A | 5 | C | 3 | D | 4 | 23 | D |
| Example 19 | D | 2 | D | 2 | C | 6 | A | 5 | C | 3 | D | 4 | 22 | D |
| Comparative Example 1 | C | 3 | D | 2 | C | 6 | E | 1 | D | 2 | C | 6 | 20 | E |
| Comparative Example 2 | C | 3 | C | 3 | C | 6 | F | 0 | D | 2 | C | 6 | 20 | E |

TABLE 6-continued

| | Evaluation U | | Evaluation V | | Evaluation W | | Evaluation X | | Evaluation Y | | Evaluation Z | | | |
|---|---|---|---|---|---|---|---|---|---|---|---|---|---|---|
| | Result | Numerical value | Result | Numerical value | Result | Numerical value | Result | Numerical value | Result | Numerical value | Result | Numerical value | Rating index | Overall evaluation |
| Comparative Example 3 | D | 2 | C | 3 | D | 4 | B | 4 | D | 2 | D | 4 | 19 | E |
| Comparative Example 4 | D | 2 | D | 2 | D | 4 | C | 3 | D | 2 | D | 4 | 17 | E |
| Comparative Example 5 | B | 4 | C | 3 | E | 2 | C | 3 | E | 1 | D | 4 | 17 | E |
| Comparative Example 6 | D | 2 | D | 2 | E | 2 | C | 3 | E | 1 | D | 4 | 14 | F |
| Comparative Example 7 | E | 1 | E | 1 | E | 2 | E | 1 | E | 1 | E | 2 | 8 | F |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-050474, filed Mar. 13, 2015, which is hereby incorporated by reference herein in its entirety.

What is claimed is:

1. A magnetic carrier comprising a magnetic carrier core and a resin covering layer formed on a surface of the magnetic carrier core, wherein the resin covering layer contains a resin component and an inorganic fine particle, a content of the inorganic fine particle in the resin covering layer being 1.0 to 10.0 parts by mass based on 100 parts by mass of the resin component in the resin covering layer, the inorganic fine particle is subjected to mechanochemical treatment, the inorganic fine particle is a fine particle of at least one oxide selected from the group consisting of MgO and $Al_2O_3$, a moisture adsorption rate of the inorganic fine particle when allowed to stand in an environment of a temperature of 30° C. and a humidity of 80% for 72 hours is 25.0% by mass or less, an electrical conductivity of the inorganic fine particle is $2.0\times10^{-9}$ to $2.5\times10^{-5}$ μS/m, and a degree of crystallinity of the inorganic fine particle is 60% or less.

2. The magnetic carrier according to claim 1, wherein a current value of the magnetic carrier during 500 V application is 2.0 to 100.0 μA.

3. A method for producing a magnetic carrier which comprises a magnetic carrier core and a resin covering layer formed on a surface of the magnetic carrier core, wherein the resin covering layer contains a resin component and an inorganic fine particle, a content of the inorganic fine particle in the resin covering layer being 1.0 to 10.0 parts by mass based on 100 parts by mass of the resin component in the resin covering layer, the inorganic fine particle is a fine particle of at least one oxide selected from the group consisting of MgO and $Al_2O_3$, the inorganic fine particle having a moisture adsorption rate of 25.0% by mass or less when allowed to stand in an environment of a temperature of 30° C. and a humidity of 80% for 72 hours, an electrical conductivity of $2.0\times10^{-9}$ to $2.5\times10^{-5}$ μS/m, and a degree of crystallinity of 60% or less, the method comprising the steps of:

(a) providing a magnetic carrier core;

(b) providing an inorganic fine particle of at least one oxide selected from the group consisting of MgO and $Al_2O_3$, which has a crystallinity of 90% or more;

(c) subjecting the inorganic fine particles provided in step (b) to a mechanochemical treatment to form an inorganic fine particles having a crystallinity of 60% or less;

(d) providing a resin solution containing a resin component and the inorganic fine particles resulting from step (c); and (e) coating a surface of the magnetic carrier core with the resin solution to form the resin covering layer.

4. The method for producing the magnetic carrier according to claim 3, wherein step (c) includes treating the inorganic fine particles provided in step (b) by a planetary ball mill or vibrating mill.

5. The method for producing the magnetic carrier according to claim 3, wherein step (c) further comprises a step of treating the inorganic fine particles having a crystallinity of 60% or less with a silane coupling agent.

* * * * *